US007918518B2

(12) United States Patent
Tanahashi et al.

(10) Patent No.: US 7,918,518 B2
(45) Date of Patent: Apr. 5, 2011

(54) INKJET RECORDING APPARATUS

(75) Inventors: Naokazu Tanahashi, Nagoya (JP); Noritsugu Ito, Tokoname (JP); Shingo Ito, Kasugai (JP); Wataru Sugiyama, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 937 days.

(21) Appl. No.: 11/761,129

(22) Filed: Jun. 11, 2007

(65) Prior Publication Data

US 2007/0291056 A1 Dec. 20, 2007

(30) Foreign Application Priority Data

Jun. 16, 2006 (JP) ..... 2006-167531

(51) Int. Cl.
*B41J 25/308* (2006.01)
*B41J 29/38* (2006.01)
*B41J 2/01* (2006.01)

(52) U.S. Cl. ..... 347/8; 347/5; 347/6; 347/9; 347/14; 347/19; 347/20; 347/22; 347/29; 347/36; 347/101; 347/104; 347/105; 347/106

(58) Field of Classification Search ..... 347/6, 8, 347/14
See application file for complete search history.

(56) References Cited

U.S. PATENT DOCUMENTS

| | | | | |
|---|---|---|---|---|
| 5,257,867 | A * | 11/1993 | Ito et al. | 400/56 |
| 5,657,057 | A * | 8/1997 | Nakajima et al. | 347/7 |
| 5,806,992 | A * | 9/1998 | Ju | 400/56 |
| 6,375,297 | B1 * | 4/2002 | Hayashi et al. | 347/14 |
| 6,561,606 | B1 * | 5/2003 | Yoshida | 347/8 |
| 6,733,102 | B2 * | 5/2004 | Hosono | 347/14 |
| 2003/0016259 | A1 * | 1/2003 | Otokita | 347/14 |
| 2004/0246284 | A1 * | 12/2004 | Murai et al. | 347/8 |
| 2006/0221111 | A1 * | 10/2006 | Ouchi et al. | 347/16 |

FOREIGN PATENT DOCUMENTS

| | | | |
|---|---|---|---|
| JP | H07-047695 | A | 2/1995 |
| JP | H07-329413 | A | 12/1995 |
| JP | 2006103278 | A | 4/2006 |

* cited by examiner

*Primary Examiner* — Ryan Lepisto
(74) *Attorney, Agent, or Firm* — Baker Botts L.L.P.

(57) ABSTRACT

An inkjet recording apparatus includes: a setting portion on which a recording medium is set; a feeder which feeds the recording medium from the setting portion in a feed direction; a recording head which ejects ink so that an image is recorded on the recording medium fed by the feeder; a gap changing device which changes a gap between the recording head and the recording medium; a judgment portion which judges a setting direction of the recording medium on the setting portion; and a changing control portion which controls the gap changing device to change the gap between the recording head and the recording medium, according to the judged setting direction of the recording medium.

12 Claims, 16 Drawing Sheets

PLAN VIEW

VIEW IN
ARROW "A"
DIRECTION

PLAN VIEW

VIEW IN
ARROW "B"
DIRECTION

INKJET RECORDING APPARATUS

The present application is based on Japanese Patent Application No. 2006-167531 filed on Jun. 16, 2006, the contents of which are incorporated herein by reference.

BACKGROUND OF THE INVENTION

1. Field of the Invention

The present invention relates to an inkjet recording apparatus including a recording head for recording an image on a recording medium by ejecting ink thereto.

2. Discussion of Related Art

Generally, there has been known an inkjet recording apparatus in which various inks are ejected from a recording head such that characters and graphics (i.e., an image) are recorded on a recording medium, e.g., a paper sheet (hereinafter, abbreviated as "a sheet"), that faces the recording head and in which the sheet is discharged by a sheet-discharge roller from an inside to an outside of the inkjet recording apparatus after the image is recorded on the sheet.

For instance, in an inkjet recording apparatus disclosed by Japanese Unexamined Patent Application Publication No. 2006-103278, a gap between the recording head and the sheet is adjustable according to a size of the sheet. In this inkjet recording apparatus, since the gap between the recording head and the sheet is adjustable according to the size of the sheet, the sheet does not contact the recording head in a case in which the sheet is deformed after the image is recorded thereon, thereby making it possible to reduce a risk that a recording surface of the sheet is stained or damaged.

Also, in an inkjet recording apparatus disclosed by Japanese Unexamined Patent Application Publication No. 7-47695, the recording head is controlled to wait for a predetermined time between a forward scanning thereof (i.e., a scanning in one of opposite directions) and a backward scanning thereof (i.e., a scanning in the other of the opposite directions). In this inkjet recording apparatus, since the recording head is controlled to wait for the predetermined time between the forward scanning and the backward scanning, fixing of the ink on the sheet is sufficiently realized, thereby making it possible to reduce the risk in which the recording surface of the sheet is stained.

Also, in an inkjet recording apparatus disclosed by Japanese Unexamined Patent Application Publication No. 7-329413, owing to an arrangement in which fine holes are formed in a surface of the sheet, it is possible to reduce the deformation of the sheet even if recording is performed by ejecting a large volume of the ink.

SUMMARY OF THE INVENTION

Hereinafter, there will be described a relationship between a sheet curl (i.e., deformation or warp of a sheet) and a direction in which the sheet is carried or fed (i.e., a feed direction), by referring to FIGS. 15A-5D. FIGS. 15A-15D are explanatory views for explaining a relationship between the deformation of a sheet P (i.e., the recording medium) and a fiber direction of the sheet P in which fibers extend. FIGS. 15A and 15C are the explanatory views for explaining a case in which the sheet P is fed in a longitudinal direction thereof. FIGS. 15B and 15D are the explanatory views for explaining a case in which the sheet P is fed in a lateral direction thereof The longitudinal direction corresponds to a direction in which long sides of the sheet P extend, and the lateral direction corresponds to a direction in which short sides of the sheet P extend. Generally, fibers composing the sheet P extend in one direction (i.e., the fiber direction), owing to the sheet-manufacturing process. Therefore, the sheet P itself is curled (namely, the sheet curl occurs) when the recording surface of the sheet P is moistened by absorbing the ink ejected from a recording head. Generally, the sheet P tends to be curled in a direction perpendicular to the fiber direction. An amount of the sheet curl is larger in the direction perpendicular to the fiber direction than in a direction parallel to the fiber direction. That is, the sheet P tends to be curled about a center axis extending in a direction parallel to the fiber direction.

Meanwhile, generally in the inkjet recording apparatus, sheet-feed rollers 60, 60 for feeding the sheet P are provided so as to extend in a direction perpendicular to the feed direction. Therefore, owing to a pressing force of the sheet-feed rollers 60, 60, the shape of the sheet P is corrected when the sheet P is curled in the direction perpendicular to the feed direction (as shown in FIG. 15A), so that the sheet P does not contact the recording head 39 (as shown in FIG. 15C).

However, the pressing force of the sheet-feed rollers 60, 60 does not act on the sheet P when the sheet P is curled in the feed direction (as shown in FIG. 15B), so that the sheet P contacts the recording head 39. In this case, there is a problem that the recording surface of the sheet P is stained because the sheet P is not smoothly carried (as shown in FIG. 15D).

The above-described problem can not be solved by the inkjet recording apparatus disclosed by the Japanese Unexamined Patent Application Publication No. 2006-103278 in which the gap between the recording head and the sheet is uniformly adjusted according to only the size of the sheet. Also, in the inkjet recording apparatus disclosed by the Japanese Unexamined Patent Application Publication No. 7-47695, it takes a long time to record the image because the recording head is controlled to wait for the respective predetermined times. Also, in the inkjet recording apparatus disclosed by the Japanese Unexamined Patent Application Publication No. 7-329413 which is arranged such that the fine holes are formed in the sheet, it is inconvenient for a user because the special sheet is required.

The present invention has been developed in view of the background discussed above. With regard to the fact that the deformation amount of the sheet caused by the absorption of ink is varied according to at least one of the fiber direction of the sheet and the shape of the sheet, it is therefore an object of the present invention to provide an inkjet recording apparatus which can cope with the deformation of the recording medium.

An inkjet recording apparatus according to a first aspect of the present invention includes: a setting portion on which a recording medium is set; a feeder which feeds the recording medium from the setting portion in a feed direction; a recording head which ejects ink so that an image is recorded on the recording medium fed by the feeder; a gap changing device which changes a gap between the recording head and the recording medium; a judgment portion which judges a setting direction of the recording medium on the setting portion; and a changing control portion which controls the gap changing device to change the gap between the recording head and the recording medium, according to the judged setting direction of the recording medium.

According to the above-described inkjet recording apparatus, even if the above-described deformation amount of the recording medium is varied, the recording medium can be smoothly carried and the recording surface of the recording medium can be prevented from being stained.

Further, an inkjet recording apparatus according to a second aspect of the present invention includes: a setting portion on which a recording medium is set; a feeder which feeds the recording medium from the setting portion in a feed direction; a recording head which ejects ink so that an image is recorded on the recording medium fed by the feeder; a drive circuit which drives the recording head so as to be capable of changing an amount of ink to be ejected from the recording head; a judgment portion which judges a setting direction of the recording medium on the setting portion; and a changing control portion which controls the drive circuit to change the amount of the ink to be ejected from the recording head, according to the judged setting direction of the recording medium.

According to the above-described inkjet recording apparatus, the deformation amount of the recording medium can be prevented from being increased. As a result, the recording medium can be smoothly carried and the recording surface of the recording medium can be prevented from being stained.

Further, an inkjet recording apparatus according to a third aspect of the present invention includes: a setting portion on which a recording medium is set; a feeder which feeds the recording medium from the setting portion in a feed direction; a recording head which ejects ink so that an image is recorded on the recording medium fed by the feeder; a carriage which carries the recording head and which is reciprocated relative to the recording medium; a judgment portion which judges a setting direction of the recording medium on the setting portion; and a changing control portion which controls the carriage to change a waiting time thereof between a scanning in one of opposite directions and a scanning in the other of the opposite directions while the carriage is reciprocated, according to the judged setting direction of the recording medium.

According to the above-described inkjet recording apparatus, the deformation amount of the recording medium can be prevented from being increased. As a result, the recording medium can be smoothly carried and the recording surface of the recording medium can be prevented from being stained.

BRIEF DESCRIPTION OF THE DRAWINGS

The above and optional objects, features, and advantages of the present invention will be better understood by reading the following detailed description of a preferred embodiment of the invention when considered in conjunction with the accompanying drawings, in which.

DETAILED DESCRIPTION OF THE PREFERRED EMBODIMENT

Hereinafter, there will be described a first preferred embodiment of the present invention by reference to the drawings. An inkjet recording apparatus relating to the present invention is connected to a computer (an external information-processing device), not shown, and mainly records an image on a recording medium based on printing data as image data transmitted from the computer. Further, the inkjet recording apparatus may be connected to an external device, such as a digital camera, so as to record, on a recording medium, an image based on image data outputted from the external device. Furthermore, the inkjet recording apparatus may be configured such that various memory media such as a memory card can be attached thereto, and may record, on a recording medium, an image based on image data stored in each one of the various memory media. It is noted that in the case where the inkjet recording apparatus is a Multi Function Device, the inkjet recording apparatus may be a small-size recording apparatus such as a complex device, or may be a one which includes a plurality of sheet-supply cassettes or an Auto Document Feeder (ADF).

Figure 1:
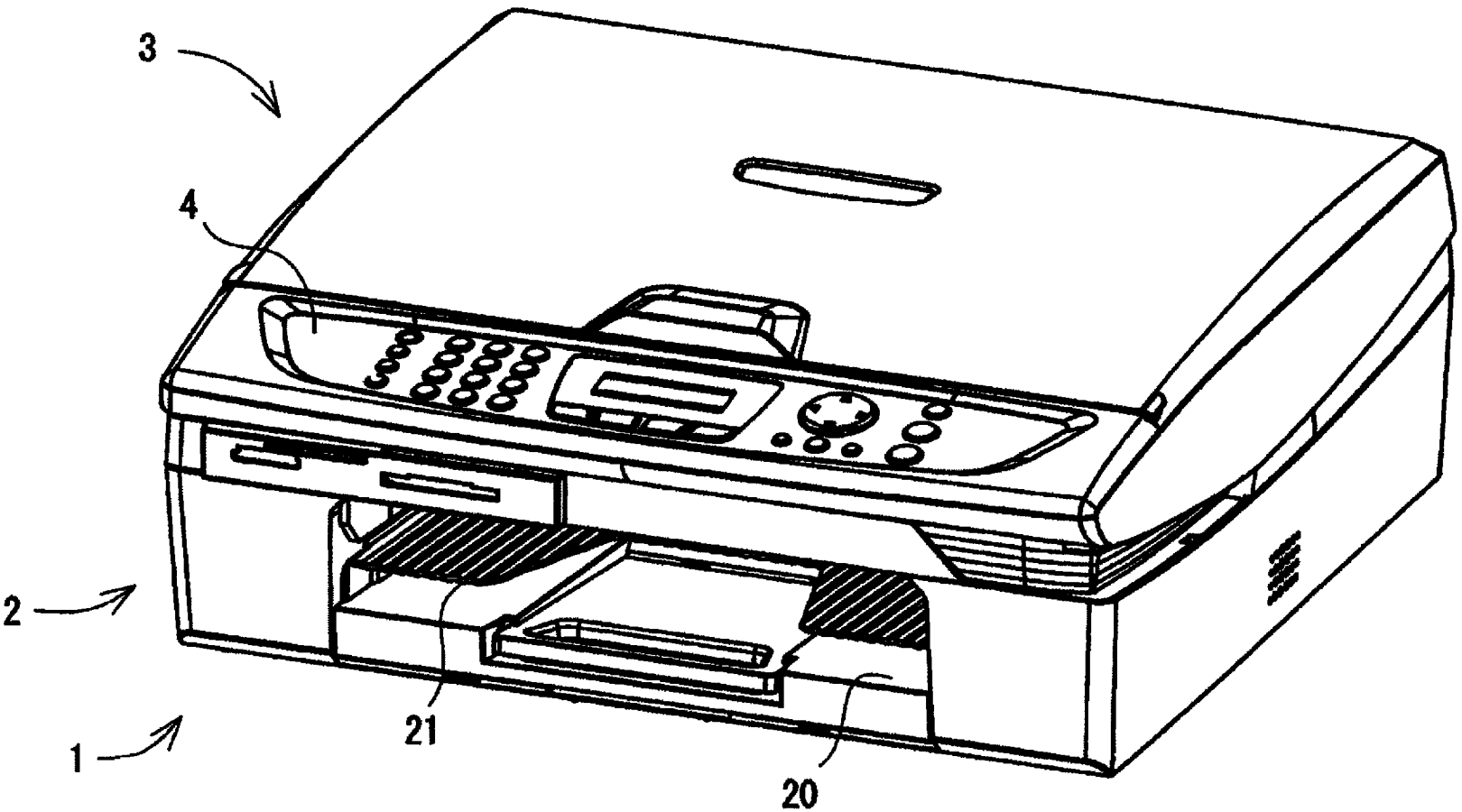
FIG. 1 is a perspective view showing an exterior configuration of a Multi Function Device (MFD) as an embodiment of the present invention which is related to a gap adjustment mechanism.

Hereinafter, there will be described the inkjet recording apparatus, by referring to FIGS. 1-9. FIG. 1 is the perspective view showing the exterior configuration of the Multi Function Device (MFD) as the first embodiment of the present invention. The MFD 1 integrally includes a printer section 2 in a lower portion thereof and a scanner section 3 in an upper portion thereof. The MFD 1 has a printer function, a scanner function, a copy function, and a facsimile function. In the MFD 1, the printer section 2 corresponds to the inkjet recording apparatus according to the present invention. The above-described functions other than the printer function are optional in the present embodiment. Therefore, in the present embodiment, the scanner section 3 may be omitted so that the MFD 1 is a single function printer which does not have the scanner function and the copy function. In an upper portion of a front side of the MFD 1, there is provided an operation panel 4 for operating the printer section 2 and the scanner section 3. The operation panel 4 includes various operation buttons and a liquid crystal display. The MFD 1 is operated based on operation commands inputted via the operation panel 4.

Figure 2:
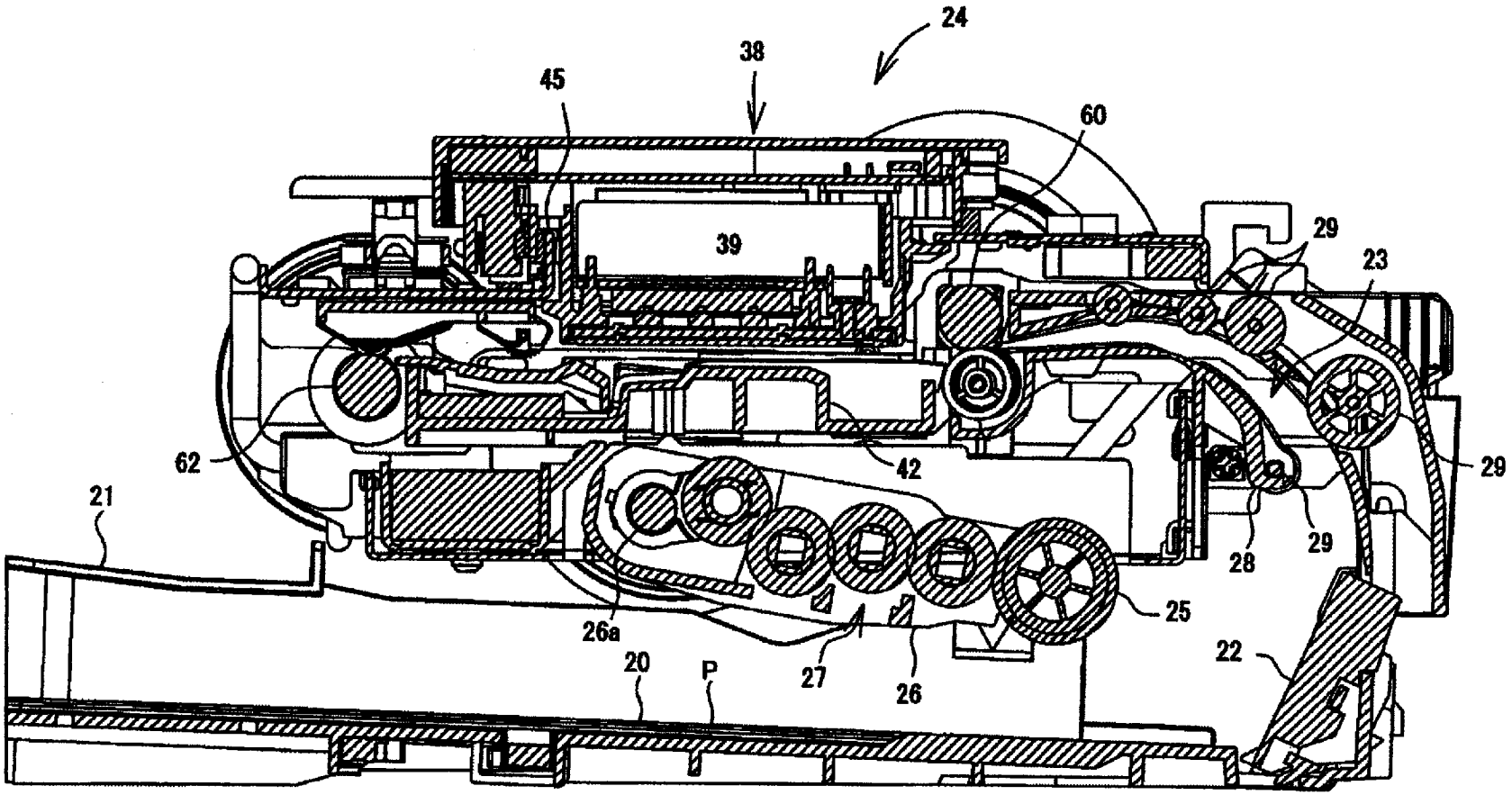
FIG. 2 is an enlarged cross-sectional view showing a principal configuration of a printer section of the MFD.

FIG. 2 is the enlarged cross-sectional view showing the principal configuration of the printer section 2. As shown in FIG. 2, a sheet-supply cassette 20 as a setting portion is capable of accommodating sheets P each as the recording medium in various sizes which are not larger than A-3 size. The sheet P is fed from the sheet-supply cassette 20, then moved inside of the printer section 2 so that the image is recorded thereon as desired, and discharged onto a sheet-discharge tray 21.

Figure 3:
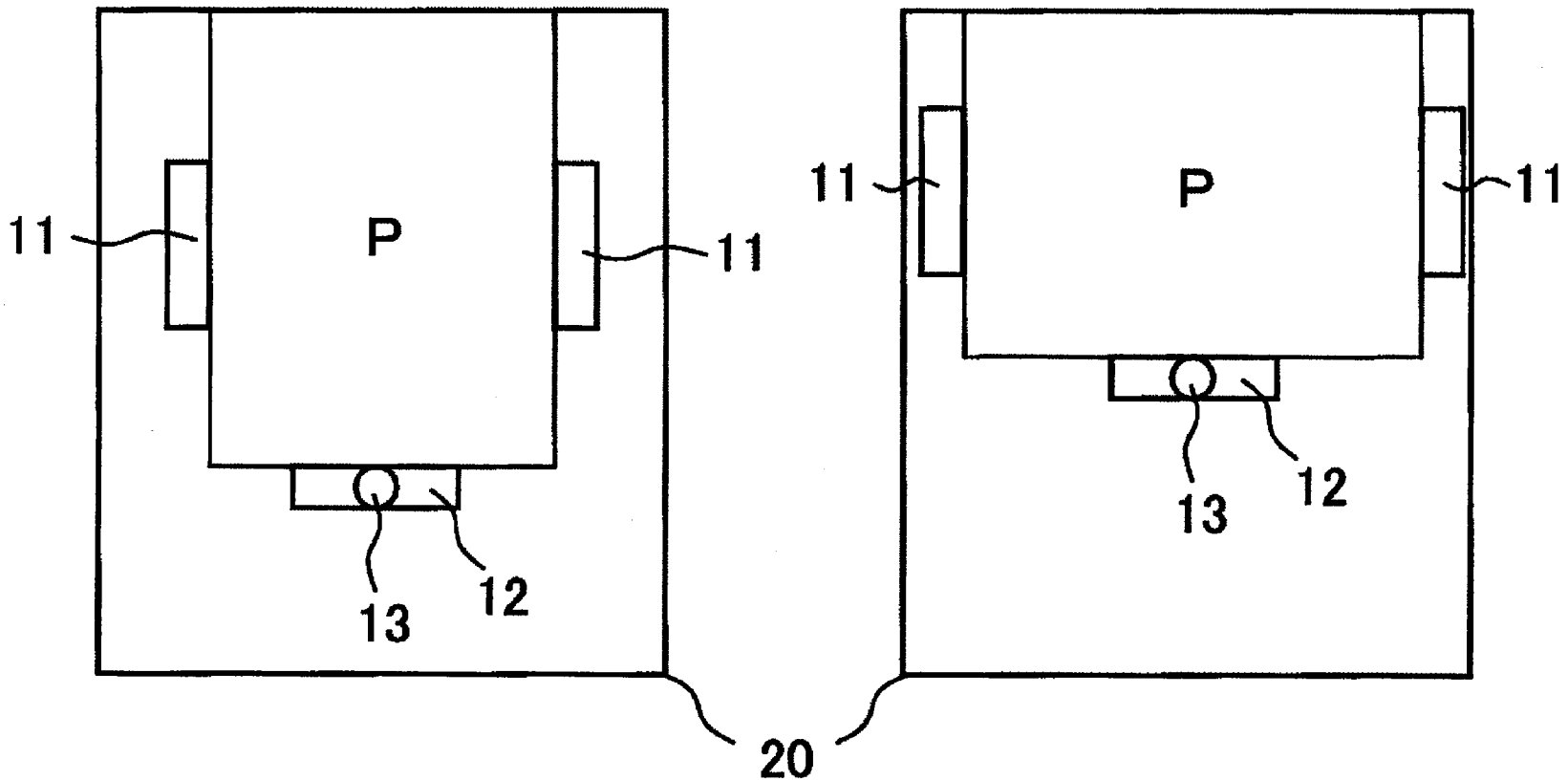
FIG. 3 is a schematic view showing a sheet-supply cassette in the printer section.

FIG. 3 is the view showing the sheet-supply cassette 20 in the printer section 2. In the sheet-supply cassette 20, there are provided a pair of side guides 11, 11 and a rear end guide 12. The side guides 11, 11 are movable in a direction perpendicular to the feed direction for positioning opposite side ends of the sheets P. The rear end guide 12 is movable in the feed direction for positioning rear ends of the sheets R Further, a sheet rear end sensor 13 is provided in the rear end guide 12. The side guides 11, 11 and the rear end guide 12 are movable according to a shape (i.e., a size) of the sheets P. When the rear end guide 12 is moved, the sheet rear end sensor 13 provided in the rear end guide 12 detects a size of the sheets P as measured in the feed direction.

As shown in FIG. 2, above the sheet-supply cassette 20, a sheet supply roller 25 as a portion of the feeder is provided for separating an uppermost one of the sheets P accommodated in the sheet-supply cassette 20 from the other sheets P, so as to supply the uppermost sheet P into a sheet-feed path 23. The sheet supply roller 25 is rotatably supported by a distal end of a sheet supply arm 26, and rotated owing to a driving force of an LF motor 71 (shown in FIG. 10) transmitted via a driving-force transmission mechanism 27 in which a plurality of gears are engaged with each other.

The sheet supply arm 26 having a shaft 26a which defines a pivot axis is disposed so as to be movable in a vertical direction, thereby making it possible to be close to or away from the sheet-supply cassette 20. The sheet supply arm 26 is downwardly pivoted by its self weight or a biasing force of a spring, etc., so as to be in contact with the sheet-supply cassette 20, and is upwardly pivoted so as to be away from the sheet-supply cassette 20 when the same 20 is attached to or detached from the MFD 1. When the sheet supply arm 26 is downwardly pivoted, the sheet supply roller 25 which is rotatably supported by the distal end of the sheet supply arm 26 is held in pressed contact with a surface of the uppermost sheet P accommodated in the sheet-supply cassette 20. In this state, when the sheet supply roller 25 is rotated, the uppermost one of the sheets P (hereinafter, just referred to "the sheet P") is moved to a sheet-separating slant plate 22, owing to a frictional force generated between a "roller" surface (i.e., an outer circumferential surface) of the sheet supply roller 25 and the surface of the sheet P. The sheet P is guided upwardly by the sheet-separating slant plate 22 since a leading end of the sheet P is brought into contact therewith, and deflected into the sheet-feed path 23.

The sheet-feed path 23 is defined by an outer guide surface and an inner guide surface, which are opposed to each other such that a predetermined space is provided therebetween, except a part where an image-recording unit 24 is disposed. For example, in a part of the sheet-feed path 23 which is provided in a rear end portion of the printer section 2, a part of the outer guide surface is formed integrally with a frame of the printer section 2 and a part of the inner guide surface is defined by a guide member 28 that is fixedly provided in the frame of the printer section 2. In the sheet-feed path 23, especially in a curved part thereof, a plurality of sheet-feed rollers 29 are rotatably provided such that a "roller" surface (i.e., an outer circumferential surface) of each of the plurality of sheet-feed rollers 29 is exposed on the outer or inner guide surface of the sheet-feed path 23. A direction in which a rotation axis of each of the plurality of sheet-feed rollers 29 extends corresponds to a widthwise direction of the sheet-feed path 23. In the curved part of the sheet-feed path 23, owing to the plurality of sheet-feed rollers 29 each of which is rotatably provided, the sheet P is smoothly moved even though the sheet P contacts the outer and inner guide surfaces of the sheet-feed path 23.

As shown in FIG. 2, the image-recording unit 24 is provided in the sheet-feed path 23. The image-recording unit 24 includes a carriage 38 which is equipped with an inkjet recording head 39 and which is reciprocatable in a main scanning direction. The inkjet recording head 39 is provided for ejecting four color inks, e.g., Cyan ink (C), Magenta ink (M), Yellow ink (Y), and Black ink (Bk), in the form of fine ink droplets, which are supplied via respective ink tubes 41 from respective ink cartridges 40 that are provided independently of the inkjet recording head 39 in the printer section 2 (shown in FIG. 4). The ink droplets are ejected from the inkjet recording head 39 while the carriage 38 is reciprocated, so that the image is recorded on the sheet P which is temporarily stopped on a platen 42.

As shown in FIG. 2, the platen 42 is provided such that an upper surface thereof faces a lower surface (i.e., a nozzle-formed surface) of the inkjet recording head 39. Within a movable area in which the carriage 38 is reciprocated, the platen 42 is disposed over a central portion of the movable area where the sheet P passes. A width of the platen 42 is adequately larger than a width of a largest-size sheet P, whereby the opposite side ends of any sheet P pass over the platen 42.

Figure 4:
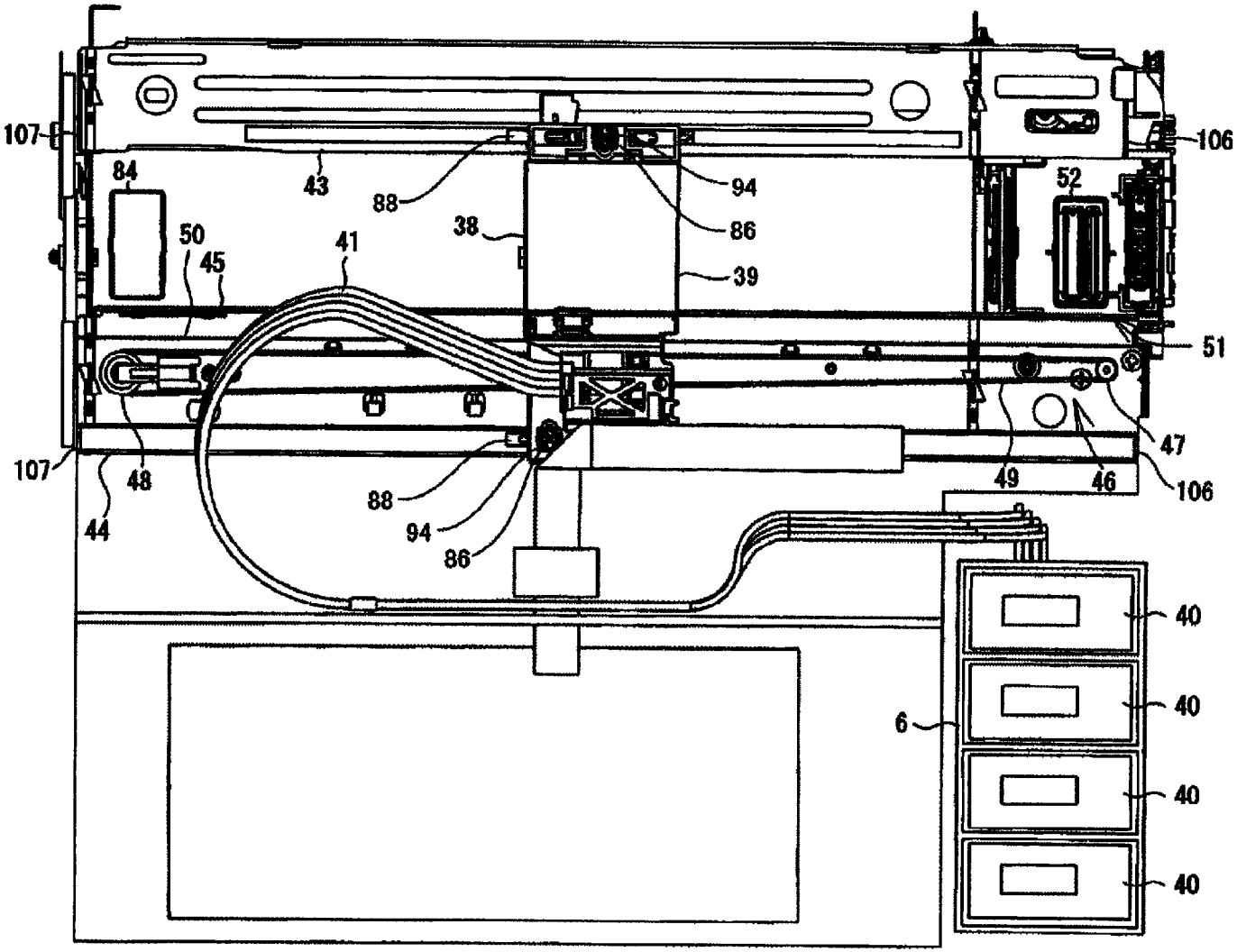
FIG. 4 is an enlarged plan view showing the principal configuration of the printer section.

FIG. 4 is the enlarged plan view showing the principal configuration of the printer section 2. As shown in FIG. 4, the ink cartridges 40 are attached to an ink cartridge attaching portion 6 which is provided in a front portion of the printer section 2. As shown in FIG. 4, the ink cartridge attaching portion 6 is disposed in the MFD 1 independently of the carriage 38 which is equipped with the inkjet recording head 39. The inks are supplied from the respective ink cartridges 40 which are attached to the ink cartridge attaching portion 6 to the inkjet recording head 39 via the respective ink tubes 41.

Figure 5:
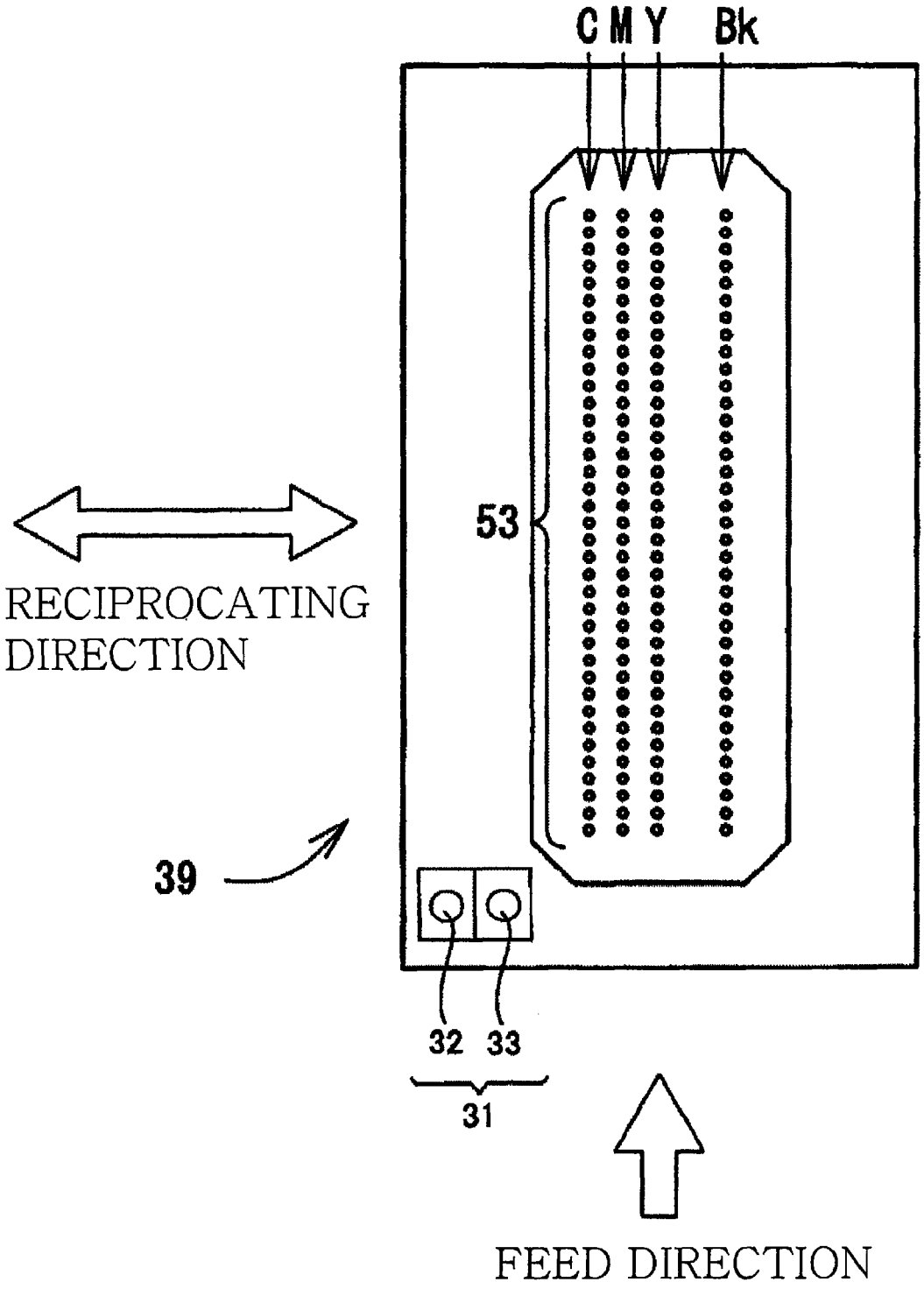
FIG. 5 is a bottom plan view of an inkjet recording head which is a component of the printer section.

FIG. 5 is the bottom plan view of the inkjet recording head 39 showing the nozzle-formed surface thereof In the lower surface of the inkjet recording head 39, a plurality of nozzle openings 53 are arranged in four rows, which correspond to the four color inks, i.e., Cyan ink (C), Magenta ink (M), Yellow ink (Y), and Black ink (Bk), and which extend in the feed direction. A total number of the nozzle openings 53 in each row and a space between any adjacent two of the nozzle openings 53 in the feed direction are properly determined in consideration of a resolution of the image to be recorded, etc. Further, it is possible to increase or decrease a number of the rows of the nozzle openings 53 according to a number of the color inks.

As shown in FIG. 5, on the lower surface of the inkjet recording head 39, a medium sensor 31 is provided. The medium sensor 31 includes a light emitting portion 32 which is constituted by a light emitting diode and a light receiving portion 33 which has an optical sensor. Light is radiated from the light emitting portion 32 of the medium sensor 31 toward the platen 42. The platen 42 reflects the light, and reflected light is received by the light receiving portion 33.

The upper surface of the platen 42 has a color, such as a black color, which has a different reflectivity from a color of the sheet P. When the sheet P does not exist, the reflected light from the platen 42 which has a low reflectivity is received by the light receiving portion 33, whereby a value detected by the medium sensor 31 (i.e., an analog-digital converted value) is low. On the other hand, when the sheet P exists, the reflected light from the sheet P which has a high reflectivity is received by the light receiving portion 33, whereby a value detected by the medium sensor 31 (i.e., an analog-digital converted value) is high. Therefore, existence or non-existence of the sheet P can be detected by the medium sensor 31 based on an amount of the reflected light detected thereby.

The above-described medium sensor 31 is mounted on an upstream-side portion of the inkjet recording head 39 in the feed direction of the sheet P and reciprocated in the main scanning direction by the carriage 38. Since the medium sensor 31 is mounted on the inkjet recording head 39, there is no need to provide a carriage for moving the medium sensor 31, in addition to the carriage 38 for moving the inkjet recording head 39. Therefore, it is possible to make the MFD 1 compact. Further, since the medium sensor 31 is disposed on the upstream-side portion of the inkjet recording head 39 in the feed direction, positions of the right and left side ends of the sheet P can be detected by the medium sensor 31 when the carriage 38 is reciprocated before the image is recorded on the sheet P.

As shown in FIG. 4, out of an area where the image is recorded by the inkjet recording head 39 (i.e., an image-recording area), there is provided a maintenance unit including a purge mechanism 51 and a waste-ink tray 84, etc. The purge mechanism 51 is constituted by a cap 52, a pump mechanism, and a moving mechanism. More specifically, the cap 52 is provided for covering the nozzle openings 53 of the inkjet recording head 39. The pump mechanism is connected to the inkjet recording head 39 via the cap 52. The moving mechanism is provided for moving the cap 52 such that the cap 52 is in contact with or removed from the nozzle openings 53 of the inkjet recording head 39. It is noted that the pump mechanism and the moving mechanism are omitted in FIG. 4.

When air bubbles or a waste ink in the inkjet recording head 39 are removed by sucking, the carriage 38 is moved such that the inkjet recording head 39 is positioned above the cap 52. In this state, as shown in FIG. 5, the cap 52 is upwardly moved to be brought into close contact with the lower surface of the inkjet recording head 39 in which the nozzle openings 53 are provided, so that the nozzle openings 53 are tightly closed by the cap 52. Then, the waste ink is sucked, by a pump which is connected to the cap 52, from the nozzle openings 53, etc., of the inkjet recording head 39. It is noted that the waste ink is stored in the waste-ink tray 84.

As shown in FIG. 4, in the sheet-feed path 23, there is provided a pair of guide frames 43, 44 which extends in the direction perpendicular to the feed direction (i.e., a rightward and leftward direction in the FIG. 4) such that the guide frame 43 is spaced from the guide frame 44 by a predetermined distance in the feed direction (i.e., an upward and downward direction in FIG. 4). The carriage 38 is laid across the guide frames 43, 44 so as to be slidably reciprocated in the direction perpendicular to the feed direction. The guide frame 43 provided on an upstream side of the guide frame 44 in the feed direction has a flat-plate shape whose length in the widthwise direction of the sheet-feed path 23 exceeds the movable area in which the carriage 38 is reciprocated. An upper surface of the guide frame 43 slidably supports one of opposite ends of the carriage 38 which is located on the upstream side in the feed direction.

The guide frame 44 which is provided on a downstream side of the guide frame 43 in the feed direction has a flat plate shape whose length in the widthwise direction of the sheet-feed path 23 is generally the same as the length of the guide frame 43. In the guide frame 44, an edge portion 45 for supporting the other one of opposite ends of the carriage 38 which is located on the downstream side in the feed direction is bended upwardly at a substantially right angle. The carriage 38 is slidably supported by an upper surface of the guide frame 44. The edge portion 45 of the guide frame 44 is held by rollers (not shown), etc, provided on the carriage 38 so as to be put therebetween. Therefore, the carriage 38 is slidably placed on and supported by the guide frames 43, 44, and reciprocated along the edge portion 45 of the guide frame 44 in the direction perpendicular to the feed direction. It is noted that, where appropriate, slide members for reducing friction are provided in portions of the carriage 38 which are held in contact with the upper surfaces of the guide frames 43, 44.

On the upper surface of the guide frame 44, a belt-driving mechanism 46 is provided. The belt-driving mechanism 46 is configured such that an endless-type timing belt 49 having teeth is stretched between a drive pulley 47 and a driven pulley 48 each of which is provided in a vicinity of a corresponding one of opposite ends of the sheet-feed path 23 in the widthwise direction. A driving force is transmitted from a CR motor 73 (shown in FIG. 10) to a shaft of the drive pulley 47. When the drive pulley 47 is rotated, the timing belt 49 is circulated. It is noted that the timing belt 49 is not limited to the endless type. Instead, a timing belt having opposite ends each of which is fixed to the carriage 38 may be adopted.

The carriage 38 is fixed to the timing belt 49 and reciprocated above the guide frames 43, 44 along the edge portion 45 of the guide frame 44, owing to the circulating movement of the timing belt 49. The inkjet recording head 39 is mounted on the carriage 38 having the above-described construction, whereby the inkjet recording head 39 is reciprocatable in the widthwise direction of the sheet-feed path 23 as the main scanning direction. Further, an encoder strip 50 of a linear encoder 77 (shown in FIG. 10) is provided along the edge portion 45 of the guide frame 44. In the linear encoder 77, the encoder strip 50 is detected by a photo interrupter (not shown). A reciprocating movement of the carriage 38 is controlled based on a signal detected by the linear encoder 77.

Figure 6:
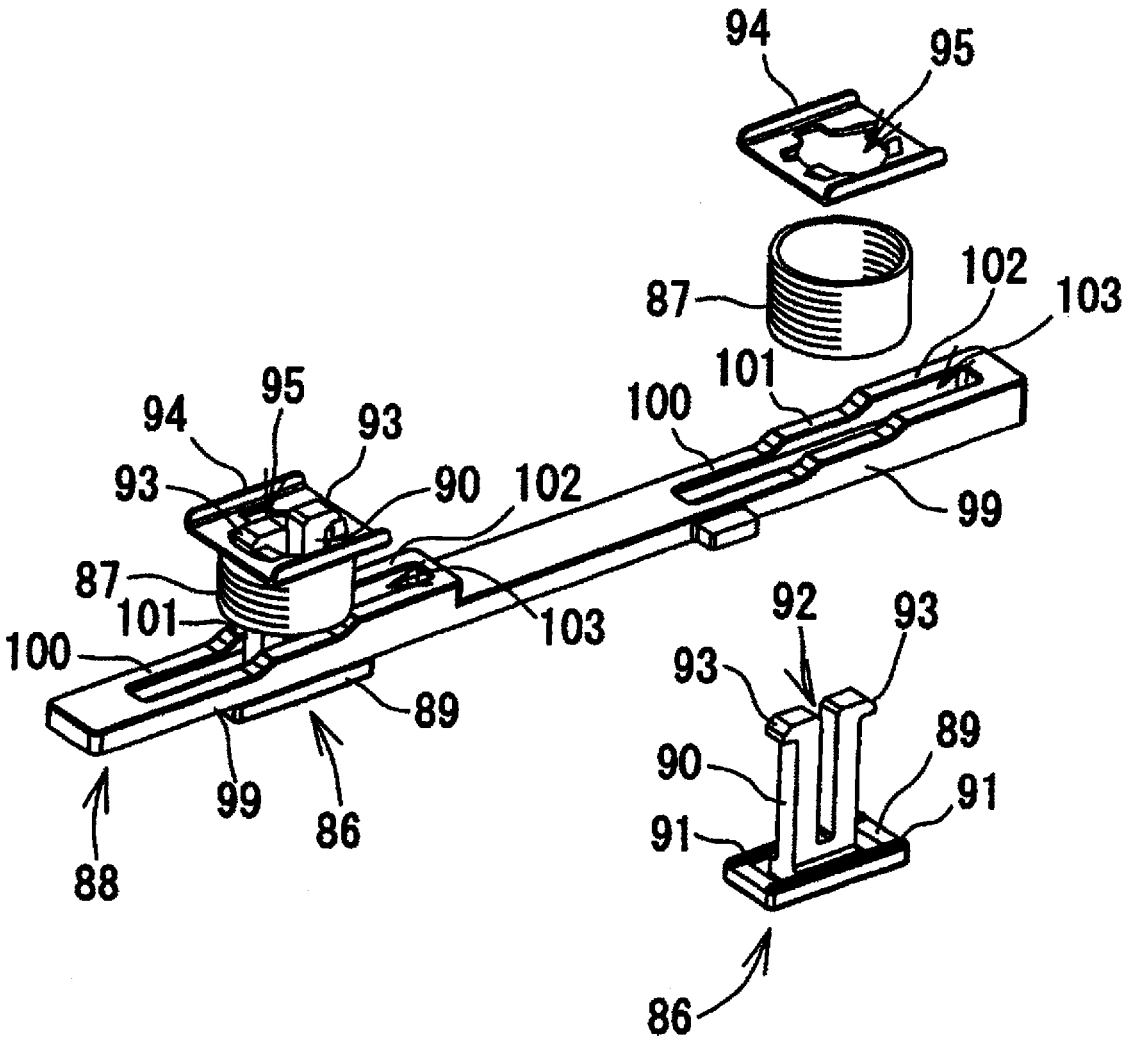
FIG. 6 is an exploded perspective view showing a configuration of a gap adjustment mechanism with which a carriage of the printer section is equipped.

Hereinafter, there will be described a first example of a gap adjustment mechanism (i.e., a gap changing device) for adjusting a gap between the inkjet recording head 39 and the sheet P (or the platen 42). FIG. 6 is the exploded perspective view showing the configurations of a slide member, 86, a coil spring 87, and a gap adjust member 88. The carriage 38 is provided with the inkjet recording head 39 and the gap adjustment mechanism having two sections. One of the two sections of the gap adjustment mechanism includes the slide members 86, 86 which slidably contact a corresponding one of the two guide frames 43, 44 for supporting the carriage 38 at a predetermined height, the coil springs 87, 87 for elastically and upwardly biasing the respective slide members 86, 86, and the gap adjust member 88 which is interposed between a supported portion 96 of the carriage 38 and the slide members 86, 86. The two sections each including the one or two slide members 86, 86, the one or two coil springs 87, 87, and the gap adjust member 88 are respectively provided on opposite side ends of the carriage 38 in the feed direction so as to correspond to the respective guide frames 43, 44. It is noted that each end of the supported portion 96 of the carriage 38 (not shown in FIG. 6) is interposed between the coil spring 87 and the gap adjust member 88.

As shown in FIG. 6, the slide member 86 includes a slidable plate portion 89 which slidably contacts the corresponding one of the guide frames 43, 44 and a leg portion 90 which extends from the slidable plate portion 89. The slidable plate portion 89 has a rectangular shape whose width is substantially the same as a width of the gap adjust member 88. The slidable plate portion 89 is moved while contacting, at its bottom surface, the corresponding one of the guide frames 43, 44. On an upper surface of the slidable plate portion 89, a pair of protruding portions 91, 91 are provided along the respective edges of long sides of the slidable plate portion 89. Since the pair of protruding portions 91, 91 are equally held in contact with a bottom surface of the gap adjust member 88, the bottom surface of the slidable plate portion 89 is positioned so as to be parallel to the upper surface of the corresponding one of the guide frames 43, 44.

Figure 16:
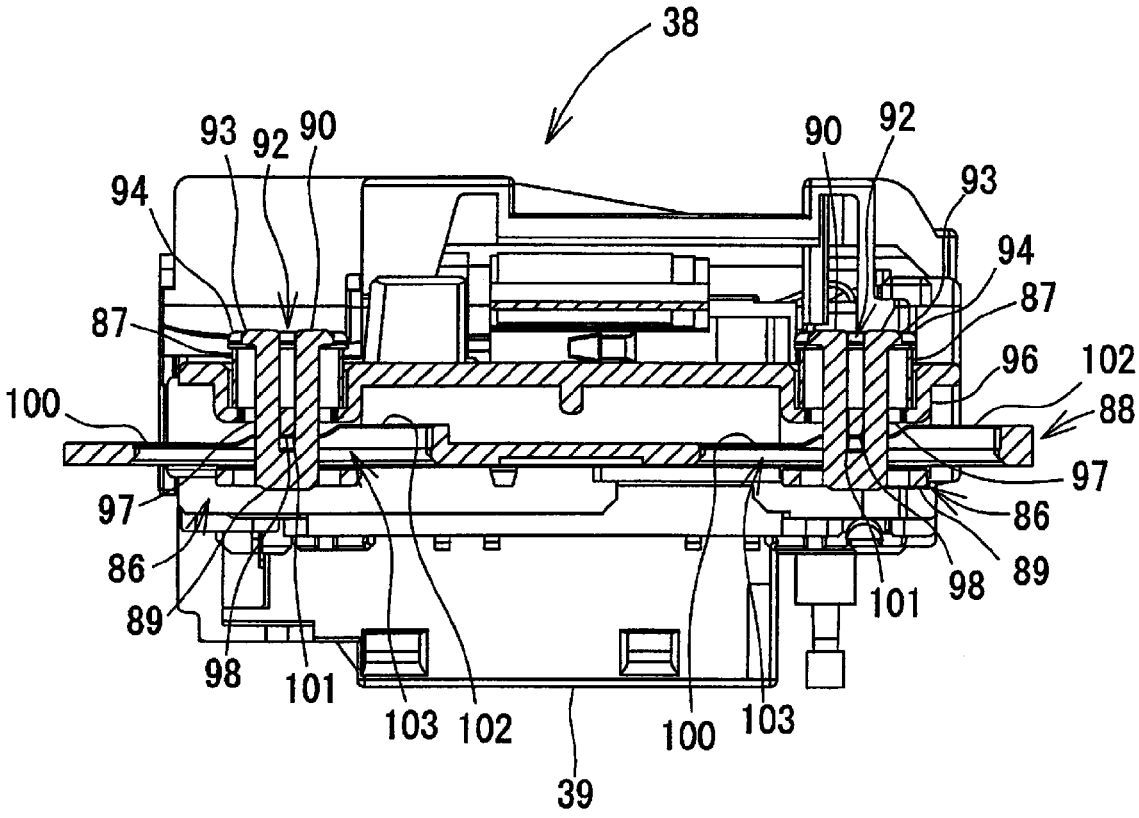
FIG. 16 is a cross-sectional view of the carriage.

The leg portion 90 extends from a center of the upper surface of the slidable plate portion 89 in a direction substantially perpendicular thereto. The leg portion 90 has a flat-plate shape which is flat in a lengthwise direction of the slidable plate portion 89. A guide recess 92 is formed through the leg portion 90 in a thickness direction thereof Further, the guide recess 92 extends in a direction in which the leg portion 90 extends, and opens in an upper end of the leg portion 90. A rib 98 as a part of the supported portion 96 of the carriage 38 is inserted into and supported by the guide recess 92, so that the slide member 86 is slidable along the guide recess 92 (as shown in FIG. 16). On opposite corner portions of the upper end of the leg portion 90, there are provided a pair of hook portions 93, 93, respectively, each of which projects outwardly from the leg portion 90 in the lengthwise direction of the slidable plate portion 89. The hook portions 93, 93 are received by a retaining plate 94 for retaining the slide member 86. A through hole 95 is formed through the retaining plate 94. The leg portion 90 is inserted into the through hole 95. A diameter of the through hole 95 is smaller than a distance between respective free ends of the hook portions 93, 93 of the leg portion 90 in the lengthwise direction of the slidable plate portion 89. When the leg portion 90 is inserted into the through hole 95, the leg portion 90 is elastically deformed since the hook portions 93, 93 thereof are inwardly pressed by an inner circumference of the through hole 95 such that a width of the guide recess 92 (as seen in the lengthwise direction of the slidable plate portion 89) is shortened. Owing to the shortened width of the guide recess 92, the leg portion 90 can be inserted through the through hole 95 of the retaining plate 94. Then, the leg portion 90 is freed of an inward pressing force given by the through hole 95 and elastically restored from the deformation. In this state, the hook portions 93, 93 of the leg portion 90 protrude radially outwardly from the circumference of the through hole 95. Owing to the pair of the hook portions 93, 93, the slide member 86 is kept such that the leg portion 90 does not come off the through hole 95.

As shown in FIG. 6, the gap adjust member 88 has a linear flat-bar shape. Opposite end parts of the gap adjust member 88 in a longitudinal direction thereof served as a pair of adjustment parts 99, 99, respectively, which are distant from each other. Each of the adjustment parts 99, 99, has a thickness which is changed by three steps in a direction in which the gap adjust member 88 slides. More specifically, in the adjustment part 99, there are integrally provided three portions including a thin portion 100, a medium portion 101, and a thick portion 102 such that the thickness of the adjustment part 99 is gradually changed in one direction. Each of the thin portion 100, the medium portion 101, and the thick portion 102 has a flat upper surface whose length is slightly longer than a width of the leg portion 90 of the slide member 86. Further, on a boundary between the thin portion 100 and the medium portion 101, and on a boundary between the medium portion 101 and the thick portion 102, there are provided slant portions, respectively, for reducing a sudden change in the thickness of the adjustment part 99.

In a center of each of the adjustment parts 99, 99 in a widthwise direction of the gap adjust member 88, there is provided a slot 103 which extends across the thin portion 100, the medium portion 101, and the thick portion 102 and which is formed through the thickness of the gap adjust member 88. A width of the slot 103 (as measured in the widthwise direction of the gap adjust member 88) is slightly wider than a thickness of the leg portion 90 (as measured in a widthwise direction of the slide member 86). The leg portion 90 is inserted through the slot 103, and a portion thereof which protrudes from the gap adjust member 88 is inserted through the through hole 97 (shown in FIG. 16) formed in the supported portion 96 of the carriage 38. Further, the above-described rib 98 of the carriage 38 is inserted into the guide recess 92 of the leg portion 90. Then, as shown in FIG. 6, the hook portions 93, 93 of the leg portion 90 are received by the retaining plate 94.

The coil spring 87 is interposed between the retaining plate 94 and the supported portion 96 of the carriage 38. Owing to the coil spring 87, the retaining plate 94 is elastically biased in the vertical direction, namely, an elastic biasing force is given to the retaining plate 94 by the coil spring 87. The elastic biasing force is applied to the slide member 86 via the retaining plate 94, so that the slide member 86 is elastically biased to be kept at a position where the upper surface of the slidable plate portion 89 of the slide member 86 is held in contact with a lower surface of the gap adjust member 88. Further, since the gap adjust member 88 is interposed between the supported portion 96 of the carriage 38 and the slidable plate portion 89 of the slide member 86, the slide member 86 is downwardly moved against the elastic biasing force by the thickness of the adjustment part 99 of the gap adjust member 88. Owing to the slot 103 provided in the adjustment part 99, the gap adjust member 88 can be slidably moved in a state in which the leg portion 90 of the slide member 86 is inserted through the gap adjust member 88 in the vertical direction. When the gap adjust member 88 is slidably moved, the thickness of the adjustment part 99, which is interposed between the rib 98 of the carriage 38 and the slidable plate portion 89 of the slide member 86, is changed. That is, the thickness of the adjustment part 99 is changed depending on which one of the thin portion 100, the medium portion 101, and the thick portion 102 is interposed between the supported portion 96 of the carriage 38 and the slidable plate portion 89 of the slide member 86. When the thickness of the adjustment part 99 is changed, a position of the slide member 86 is changed in the vertical direction.

The two gap adjust members 88, 88 provided on the upstream and downstream guide frames 43, 44 cooperate with each other for keeping all of the slide members 86 at a certain height. When the gap adjust members 88, 88 are slid or moved to respective certain positions by abutting of respective ends thereof which is caused by the movement of the cartridge 38, all of the slide members 86 are kept at the same height. In this arrangement, the carriage 38 is held parallel to the upper surfaces of the guide frames 43, 44. Further, the carriage 38 is shifted in the vertical direction in a state in which the inkjet recording head 39 is horizontally held. Accordingly, the gap between the inkjet recording head 39 and the sheet P or the platen 42 is horizontally kept in the image-recording area, whereby the image is recorded with high accuracy. It is noted that a total number of the slide members 86 can be appropriately changed.

In the printer section 2 according to the present embodiment, the slide members 86 are provided for holding the carriage 38 having the inkjet recording head 39 at the predetermined height above the guide frames 43, 44. Each of the gap adjust members 88, 88 is interposed between the carriage 38 and the slidable plate portion or portions 89 of the corresponding slide member or members 86, 86. A height position of the carriage 38 supported by the slide members 86 is changed by slidably moving the gap adjust members 88, 88. Owing to the above-described arrangement, the gap between the inkjet recording head 39 and the sheet P can be adjusted.

Hereinafter, there will be described a second example of the gap adjustment mechanism (i.e., the gap changing device). Except a carriage 110, a printer section related to the second example of the gap adjustment mechanism has substantially the same construction as the above-described printer section 2 related to the first example of the gap adjustment mechanism. Therefore, there will be described only the carriage 110 having a different construction from that of the above-described carriage 38. It is noted that the same reference numerals as used in the first example are used to designate the corresponding elements or parts of the second example and the description thereof is omitted.

Figure 7:
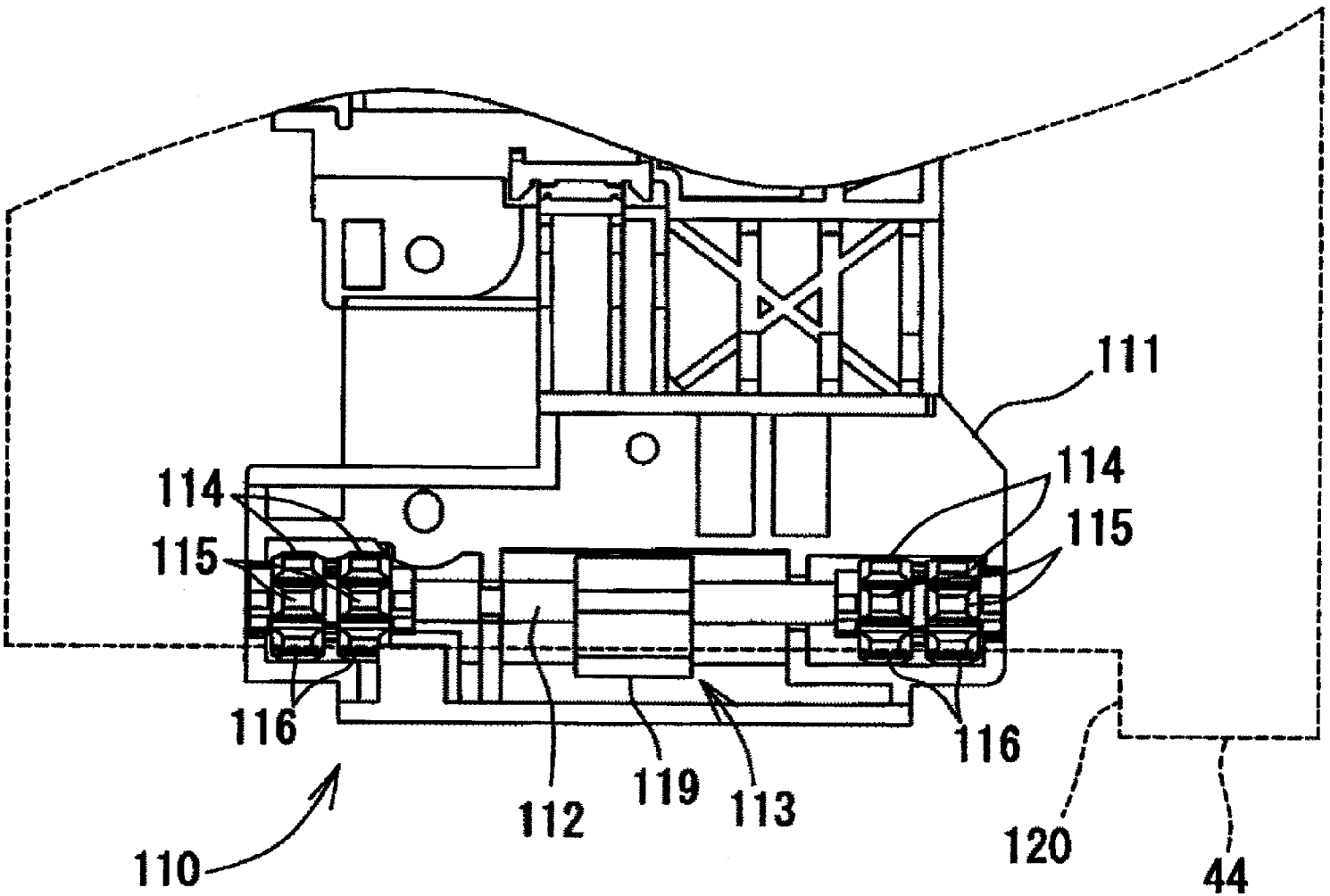
FIG. 7 is a partial bottom plan view showing a bottom surface of the carriage which is equipped with a second gap adjustment mechanism.
Figure 8:
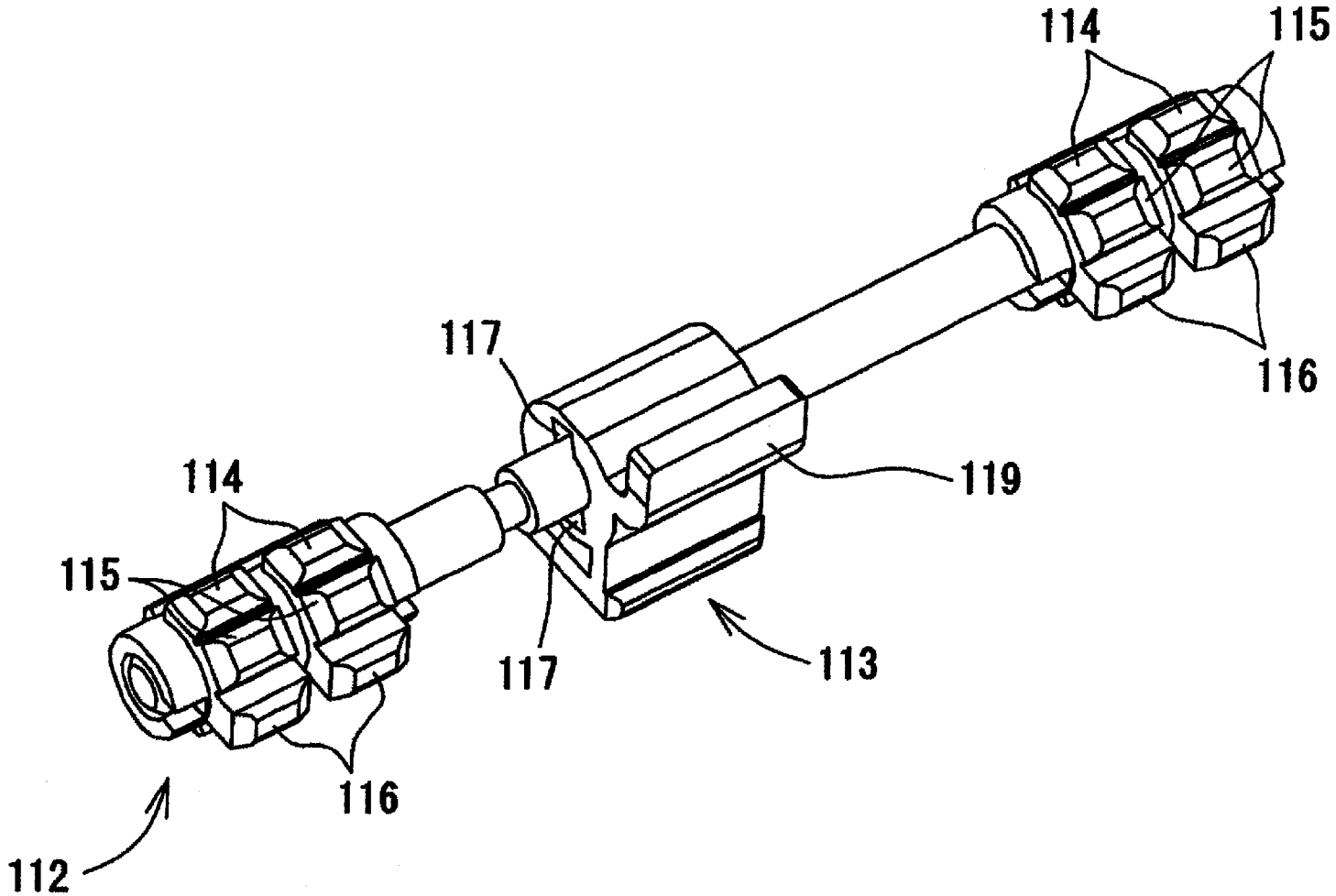
FIG. 8 is a perspective view showing an exterior configuration of the second gap adjustment mechanism.
Figure 9:
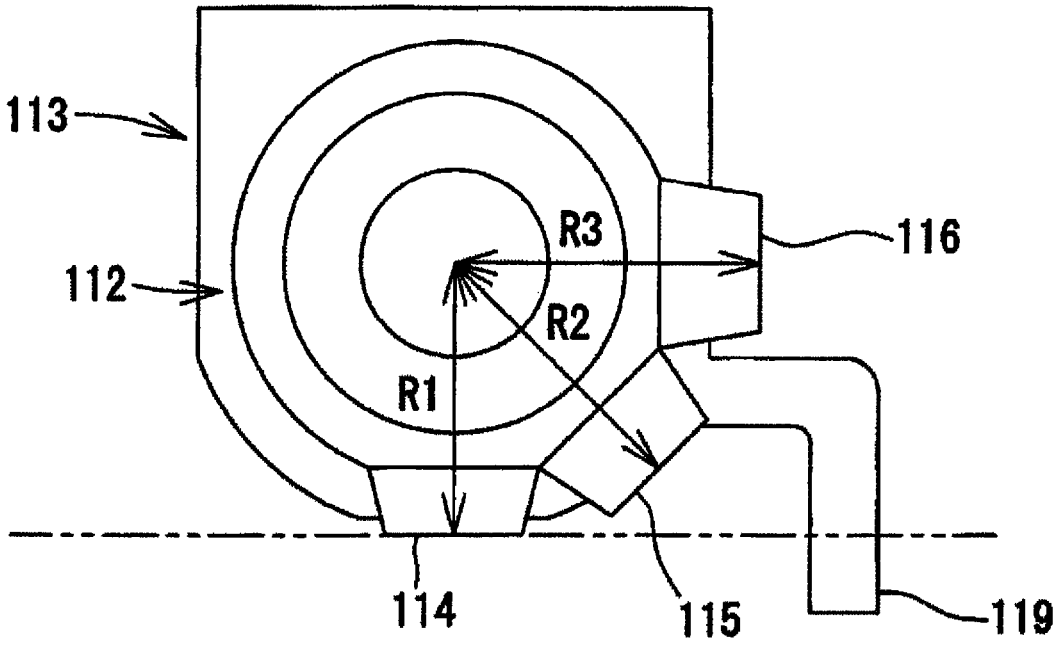
FIG. 9 is a side view of the second gap adjustment mechanism.

FIG. 7 is the partial bottom plan view showing the bottom surface of the carriage 110. The gap adjustment mechanism has two sections each of which includes a rotation shaft 112 and a slider 113. The two rotation shafts 112, 112 are provided in opposite ends of a carriage body 111 located on the upstream and downstream guide frames 43, 44, respectively. The two rotation shafts 112, 112 correspond to the two guide frames 43, 44. Further, the two sliders 113, 113 are provided in the same manner as the above-described rotation shafts 112, 112. It is noted that the rotation shaft 112 and the slider 113 which are provided on the upstream side in the feed direction are omitted from FIG. 7 since the two sections of the gap adjustment mechanism corresponding to the opposite ends of the carriage body 111 have substantially the same construction. FIG. 8 is the perspective view showing the exterior configurations of the rotation shaft 112 and the slider 113. FIG. 9 is the side view of the rotation shaft 112 and the slider 113.

As shown in FIG. 7, the carriage 110 includes the carriage body 111 which is provided with the inkjet recording head 39 and the two sections of the gap adjustment mechanism. Each section includes the rotation shaft 112 which is held in contact with the corresponding one of the guide frames 43, 44 for supporting the carriage body 111 at a predetermined height, and the slider 113 for rotating the rotation shaft 112.

As shown in FIG. 7, the rotation shaft 112 is supported by the carriage body 111 such that selected one of three sets each including eight slidable portions 114, 115, 116 provided on an outer circumference thereof is downwardly protruded from the carriage body 111 in a gravity direction. Owing to the selected set of slidable portions 114, 115, 116 provided on the two rotation shafts 112, 112 placed on the upstream and downstream guide frames 43, 44, the carriage body 111 is horizontally held. Therefore, as described above, the carriage body 111 is reciprocated in a state in which each of the slidable portions 114, 115, 116 constituting the selected set is slidably held in contact with the corresponding one of the guide frames 43, 44.

As shown in FIG. 9, the slidable portion 114, the slidable portion 115, and the slidable portion 116 are protruded outwardly from a rotation axis of the rotation shaft 112 at respective different lengths each as measured in a radial direction (i.e., respective different protruding lengths). The protruding length of the slidable portion 114 is the shortest and the protruding length of the slidable portion 116 is the longest, namely, the protruding lengths of the slidable portions 114, 115, 116 gradually increase in this order. The above-described three sets of slidable portions 114, 115, 116 are provided adjacent to each other in this order on the outer circumferential surfaces of the opposite ends of each the two rotation shafts 112. Further, each of the slidable portions 114, 115, 116 constituting each of the three sets is located at the same position in a circumferential direction of the rotation shaft 112 regardless of whether a position of the each slidable portion in an axial direction of the rotation shaft 112 is in one or the other of the opposite end portions thereof As shown in FIG. 8, the rotation shaft 112 is inserted through the slider 113 such that the slider 113 is positioned in a middle portion of the rotation shaft 112 in the axial direction. The slider 113 has a cylindrical shape which is slidable along the outer circumference of the rotation shaft 112. On an inner circumferential surface of the slider 113, there are formed a pair of engagement grooves 117, 117 each of which has a spiral shape. On the outer circumference of the rotation shaft 112, there is formed, at the center thereof, a pair of engagement projections (not shown) which outwardly projects therefrom in the radial direction. Each of the engagement projections of the rotation shaft 112 is fitted in a corresponding one of the engagement grooves 117, 117 of the slider 113, so that the rotation shaft 112 is engaged with the slider 113. When the slider 113 is slidably moved in the axial direction of the rotation shaft 112, the engagement projections are slidably moved along the engagement grooves 117, 117, respectively. Accordingly, the rotation shaft 112 is rotated. That is, owing to the engagement grooves 117, 117 and the engagement projections, the rotation shaft 112 is rotated as a result of a sliding movement of the slider 113.

As shown in FIG. 8, on an outer circumferential surface of the slider 113, there is provided a projecting portion 119 having an L-shape which outwardly projects therefrom in the radial direction. As shown in FIG. 7, in a state in which the rotation shafts 112, 112 and the sliders 113, 113 are attached to the carriage body 111, each of the projecting portions 119, 119 projects downwardly form a bottom surface of the carriage body 111. When the carriage 110 is slidably moved to a predetermined position on the guide frames 43, 44, the projecting portions 119, 119 are brought into contact with contact parts 120, 120, respectively, each of which is formed by cutting out a part of the corresponding one of the guide frames 43, 44. When the carriage 110 is further slidably moved, the sliders 113, 113 are slidably moved along the rotation shafts 112, 112, respectively, in the axial direction thereof.

Figure 10:
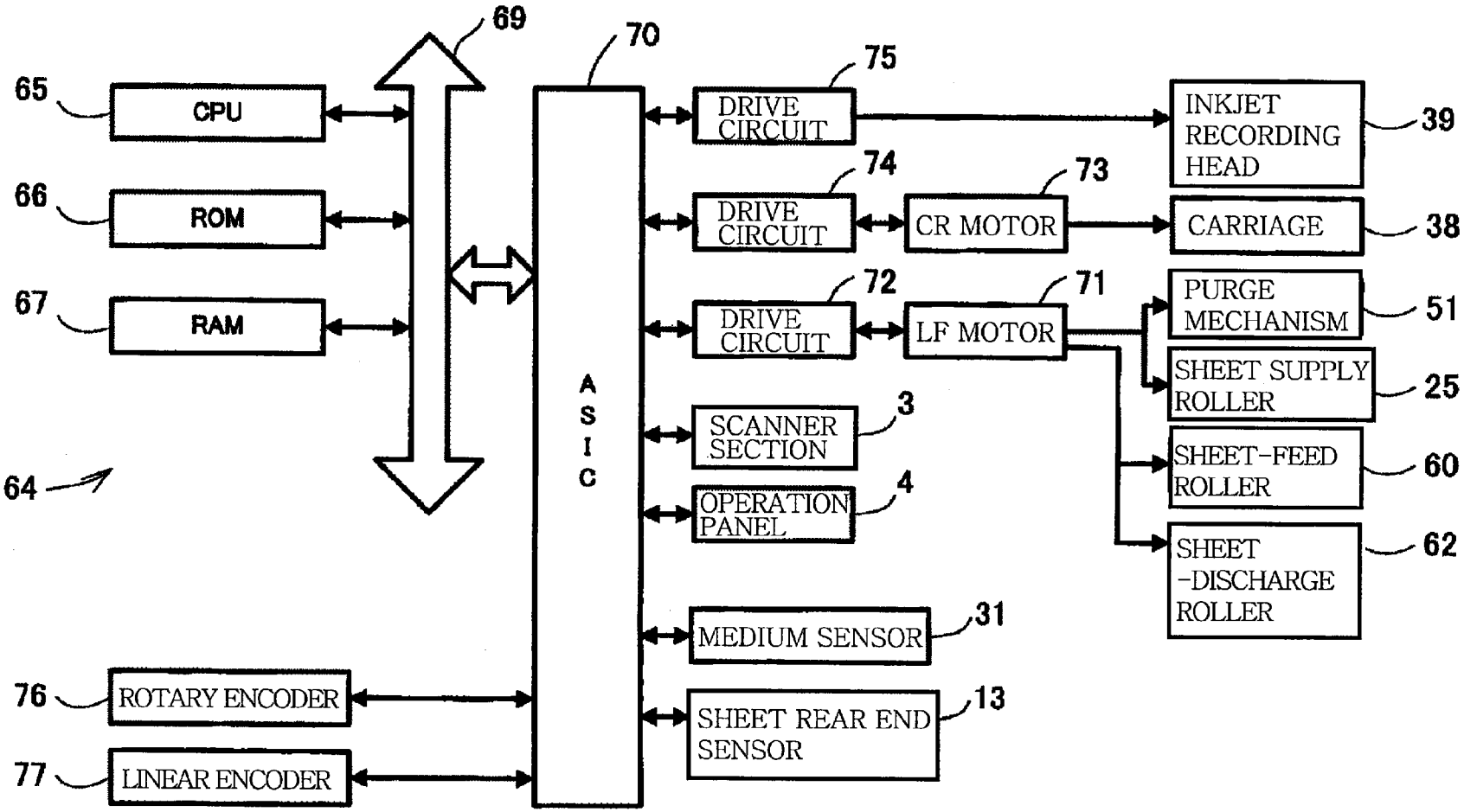
FIG. 10 is a block diagram showing a configuration of a control section of the MFD.

As shown in FIG. 10, a control section 64 is provided for controlling a reciprocating movement of the carriage 110 such that rotational positions of the rotation shafts 112, 112 are changed by abutting of the sliders 113, 113 with the contact parts 120, 120, respectively. As shown in FIG. 9, the slidable portions 114 each having a shortest protruding length "R1" as measured from the rotation axis in the radial direction are held in contact with upper surfaces 121, 121 of the guide frames 43, 44, whereby the carriage body 111 is supported at the lowest height position of three height positions. In this state, the gap between the inkjet recording head 39 and the sheet P (i.e., the recording medium) or the platen 42 is the smallest, whereby the image can be recorded with high resolution.

As described above, in the second example of the gap adjustment mechanism, on the outer circumferential surface of each of the rotation shafts 112, 112, there are provided sets of the slidable portions 114, 115, 116 outwardly protruding at the different protruding lengths in the radial direction for supporting, at the predetermined height above the guide frames 43, 44, the carriage body 111 on which the inkjet recording head 39 is mounted. When each of the rotation shafts 112, 112 is rotated by the corresponding one of the sliders 113, 113 which is slidably moved, one set of the slidable portions 114, 115, 116 is selected. Since the slidable portion 114, the slidable portion 115, and the slidable portion 116 have the respective protruding lengths mutually different, the height position of the carriage body 111 is changed according to the selected set of the slidable portions 114, 115, 116. Owing to the above-described arrangement, the gap between the inkjet recording head 39 and the sheet P or the platen 42 can be adjusted.

FIG. 10 is the block diagram showing the configuration of the control section 64 for controlling the printer section 2. As shown in FIG. 10, the control section 64 is configured as a micro computer mainly including a CPU (Central Processing Unit) 65, a ROM (Read Only Memory) 66, and a RAM (Random Access Memory) 67. The control section 64 is connected to an ASIC (Application Specific Integrated Circuit) 70 via a bus 69.

In the ROM 66, there are stored programs, etc., for controlling various operations of the printer section 2. The RAM 67 functions as an image area or a work area where there are temporarily stored various data to be used when the above-described programs are executed by the CPU 65.

Based on a command inputted from the CPU 65, a phase excitation signal for energizing the LF motor 71, etc., is generated by the ASIC 70 and applied to a drive circuit 72 of the LF motor 71. The ASIC 70 controls a rotation of the LF motor 71 by applying a drive signal to the LF motor 71 via the drive circuit 72 such that the drive signal energizes the LF motor 71.

The drive circuit 72 is provided for driving the LF motor 71 which is connected to the sheet supply roller 25, a sheet-feed roller 60, a sheet-discharge roller 62, and the purge mechanism 51. The drive circuit 72 receives output signals outputted from the ASIC 70 and generates electric signals for rotating the LF motor 71. By receiving the electric signals, the LF motor 71 is rotated. A rotational force of the LF motor 71 is transmitted to the sheet supply roller 25, the sheet-feed roller 60, the sheet-discharge roller 62, and the purge mechanism 51 via a generally known driving mechanism including a gear and a driving shaft, etc.

Further, according to a command inputted from the CPU 65, a phase excitation signal for energizing the CR motor 73, etc., is generated by the ASIC 70 and applied to a drive circuit 74 of the CR motor 73. The ASIC 70 controls a rotation of the CR motor 73 by applying drive signals to the CR motor 73 via the drive circuit 74 such that the drive signals energize the CR motor 73.

The drive circuit 74 is provided for driving the CR motor 73 which is connected to the carriage 38. The drive circuit 74 receives output signals outputted from the ASIC 70 and generates electric signals for rotating the CR motor 73. By receiving the electric signals, the CR motor 73 is rotated. A rotational force of the CR motor 73 is transmitted to the carriage 38 via the belt-driving mechanism 46, so that the carriage 38 is reciprocated. In the above-described manner, the reciprocating movement of the carriage 38 is controlled by the control section 64.

The drive circuit 75 is provided for selectively ejecting the ink from the inkjet recording head 39 to the sheet P at a predetermined timing. By receiving output signals generated by the ASIC 70 based on drive-controlling procedure information outputted from the CPU 65, the drive circuit 75 controls an operation of the inkjet recording head 39.

A rotary encoder 76 for detecting a rotation amount of the sheet-feed roller 60 and the linear encoder 77 for detecting a movement amount of the carriage 38 are connected to the ASIC 70. Further, to the ASIC 70, there are connected the scanner section 3, the operation panel 4 for operating the printer section 2, the medium sensor 31 which is mounted on the carriage 38 for detecting a dimension of the sheet P as measured in the direction perpendicular to the feed direction (i.e., a widthwise dimension), and the sheet rear end sensor 13 which is provided in the rear end guide 12 of the sheet-supply cassette 20 for detecting a dimension of the sheet P as measured in the feed direction (i.e., a lengthwise dimension).

Figure 11:
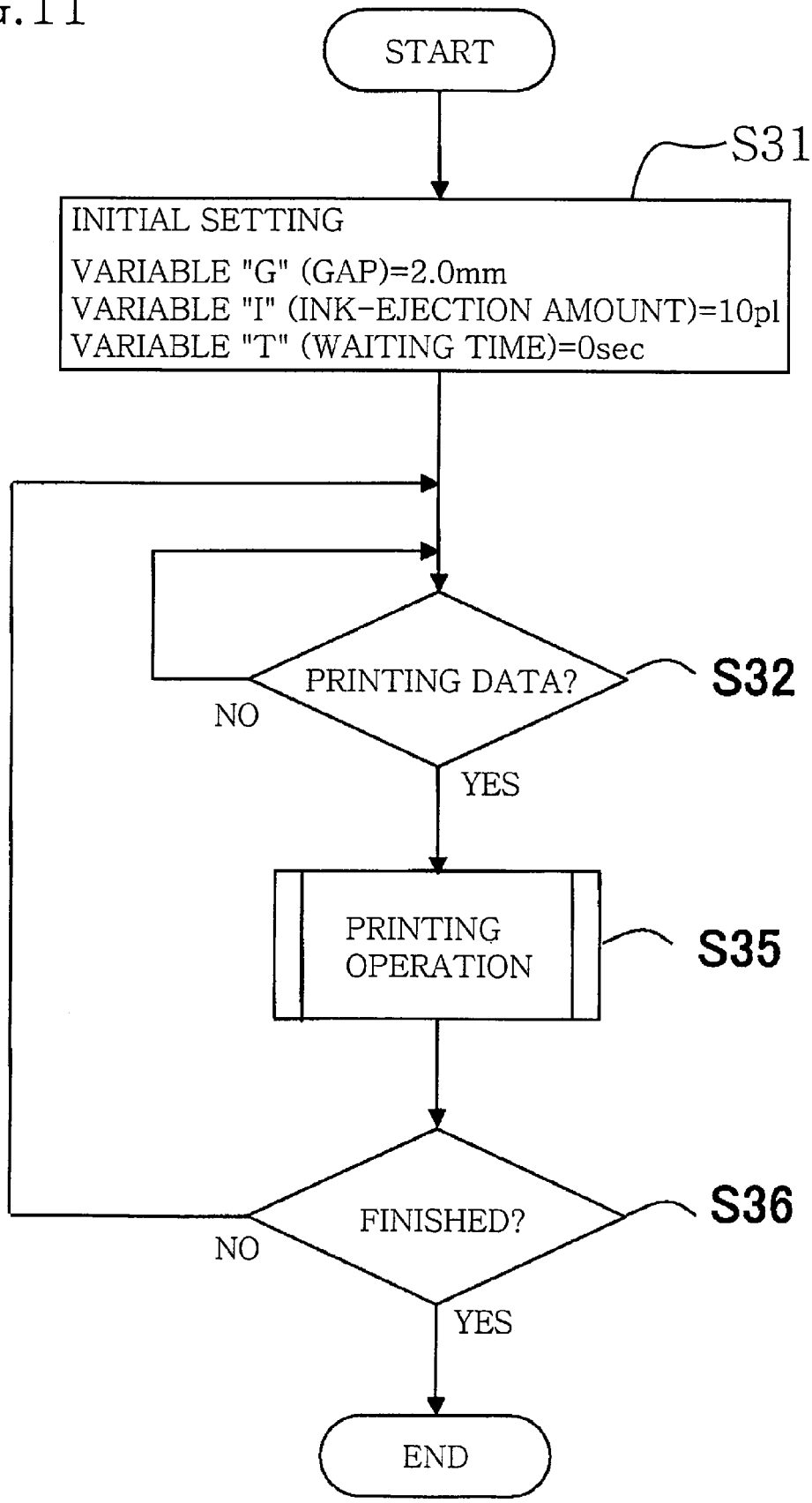
FIG. 11 is a flowchart of a printing operation to be performed by the printer section.

Next, there will be described a printing operation of the printer section 2 having the above-described configuration. FIG. 11 is a flowchart of the printing operation of the printer section 2. In the printing operation, a variable G indicating the gap between the inkjet recording head 39 and the sheet P is set at 2.0 mm as an initial value (step 31; hereinafter, abbreviated as "S31"). Variables I and T will be described later. Subsequently, it is judged whether there are any printing data (S32). When there are no printing data (S32: No), it is repeatedly judged whether there are any printing data. When there is printing data (S32: Yes), a printing operation is started (S35). Then, it is judged whether the printing operation has been finished (S36). When the printing operation has not been finished (S36: No), the control goes back to "S32" in which it is judged whether there are any printing data, and the following steps are executed again. When the printing operation has been finished (S36: Yes), the control is ended.

There will be specifically described a gap-adjusting operation, by referring to the first example of the gap adjustment mechanism. As shown in FIG. 4, the carriage 38 on which the inkjet recording head 39 is mounted is supported by the slide members 86 at the predetermined height above the guide frames 43, 44. As described above, in the first example of the gap adjustment mechanism, the height position of the carriage 38 is changed in three steps (e.g., a low position, a medium position, and a high position), owing to a change in the thickness of each of the adjustment parts 99 of the gap adjust members 88.

As shown in FIG. 6, in the initial state of the first example of the gap adjustment mechanism, the height position of the carriage 38 is set at the medium position in the three steps. The medium position in the three steps is determined by the state in which the medium portion 101 of each of the adjustment parts 99 of the gap adjust members 88, 88 is interposed between the rib 98 (shown in FIG. 16) of the carriage 38 and the slidable plate portion 89 of the corresponding one of the slide members 86. It is noted that the gap is 2.0 mm when the carriage 38 is supported at the medium position.

If, in a later-described step "S4", the variable G is changed, the control section 64 controls the carriage 38 to be moved to widen the gap so that respective right ends of the gap adjust members 88, 88 (as seen in the direction in which the gap adjust members 88 slide) are brought into contact with contact parts 106, 106, respectively, each of which is formed in a right end of the corresponding one of the guide frames 43, 44 (as shown in FIG. 4). In this state, when the carriage 38 is further moved, the respective positions of the gap adjust members 88, 88 are changed as the right end portions of the gap adjust members 88, 88 are inserted into the carriage 38. Accordingly, each of the thick portions 102 of the adjustment parts 99 of the gap adjust members 88, 88 is interposed between the rib 98 (shown in FIG. 16) of the carriage 38 and the slidable plate portion 89 of the corresponding one of the slide members 86. In this state, the carriage 38 is kept by the slide members 86 at the high position in the three steps. In this state, the gap is 2.8 mm.

When the image is recorded with the high resolution, the gap can be set to be narrower than the gap in the initial state. In this case, the control section 64 drives the CR motor 73 to be rotated in a predetermined direction so that the carriage 38 is moved toward a position where the waste-ink tray 84 is provided (as shown in a left portion of FIG. 4). While the carriage 38 is moved toward the above-described position above the guide frames 43, 44, respective left ends of the gap adjust members 88, 88 which are projected outwardly from the carriage 38 are brought into contact with contact portions 107, 107, respectively. In this state, when the carriage 38 is further moved, the gap adjust members 88, 88 slide rightward with respect to the carriage 38 so that the respective positions of the gap adjust members 88, 88 are changed as the respective left ends of the gap adjust members 88, 88 are inserted into the carriage 38. Accordingly, each of the thin portions 100 of the adjustment parts 99 of the gap adjust members 88, 88 is interposed between the rib 98 (shown in FIG. 16) of the carriage 38 and the corresponding one of the slidable plate portions 89 of the slide members 86. In this state, the gap is 1.6 mm.

Figure 12:
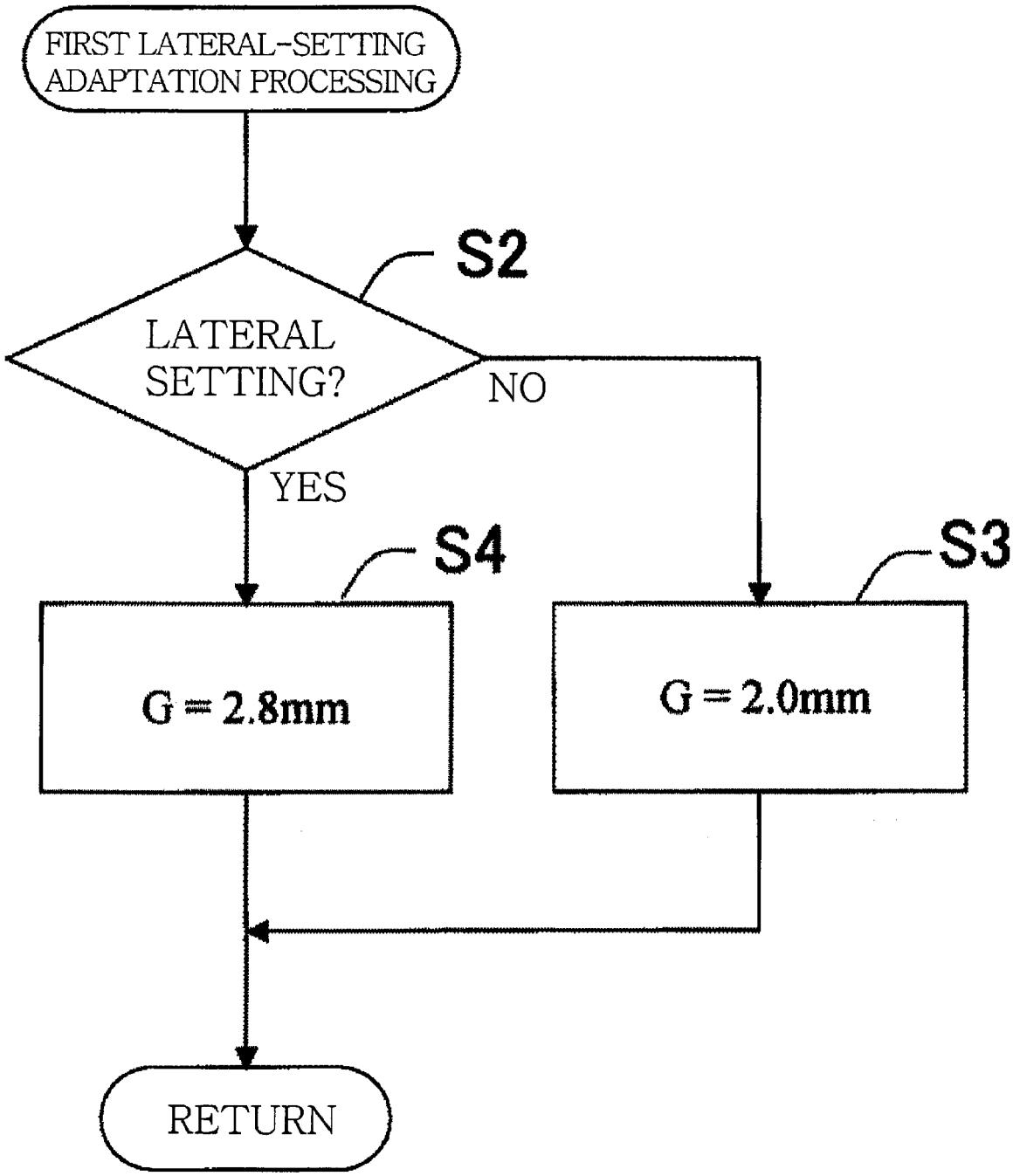
FIG. 12 is a flowchart of a first lateral-setting adaptation processing executable in the printing operation.

In the printing operation shown in FIG. 11, when it is detected that the longitudinal direction of the sheet P is perpendicular to the feed direction, a lateral-setting adaptation processing is executed, as shown in FIG. 12. FIG. 12 is the flowchart of the first lateral-setting adaptation processing. Hereinafter, there will be described an operation for detecting a setting direction of the sheet P, and the lateral-setting adaptation processing, in this order. The setting direction of the sheet P is defined by the longitudinal direction of the sheet P. It is noted that the setting direction of the sheet P is a longitudinal setting or a lateral setting. In the lateral setting, the sheet P is set in the sheet-supply cassette 20 such that the short sides of the sheet P extend in the feed direction, namely, the setting direction of the recording medium is perpendicular to the feed direction. On the other hand, in the longitudinal setting, the sheet P is set such that the long sides of the sheet P extend in the feed direction, namely, the setting direction of the recording medium is parallel to the feed direction.

Initially, there will be described the operation for detecting the setting direction of the sheet P (i.e., the longitudinal setting or the lateral setting). As shown below, table 1 shows a relation ship between combination of size and setting direction of a sheet P and combination of length and width dimensions of a sheet P. The length dimension (as measured in the feed direction) of a sheet P is detected by the sheet rear end sensor 13 functioning as a first recording medium sensor (shown in FIG. 3), and the width dimension (as measured in the direction perpendicular to the feed direction) of a sheet P is detected by the medium sensor 31 functioning as a second recording medium sensor (shown in FIG. 5). More specifically, when the carriage 38 is moved above a sheet P, respective opposite boundaries between a sheet P (i.e., opposite side edges of a sheet P) and the platen 42 as seen in the direction perpendicular to the feed direction are detected by the medium sensor 31. Then, respective positions of the opposite boundaries are detected based on respective positions of the carriage 38 which correspond to the respective positions of the opposite boundaries. Based on a distance between the detected positions of the opposite boundaries, the width dimension of the sheet P is detected. As a result, when the width dimension of a sheet P is greater than the length dimension thereof, the setting direction thereof is detected as the lateral setting in which the longitudinal direction of the sheet P is perpendicular to the feed direction. Further, when the detected combination of length and width dimensions of a sheet P agrees with any one of the regular sizes shown in table 1, the size and the setting direction of the sheet P are detected or identified.

TABLE 1

| LENGTH DIMENSION OF SHEET P/mm | WIDTH DIMENSION OF SHEET P/mm | SIZE OF SHEET P/ SETTING DIRECTION |
|---|---|---|
| 210 (±2) | 297 (±2) | A4/LATERAL |
| 148 (±2) | 210 (±2) | A5/LATERAL |
| 105 (±2) | 148 (±2) | A6/LATERAL |
| 182 (±2) | 257 (±2) | B5/LATERAL |

TABLE 1-continued

| LENGTH DIMENSION OF SHEET P/mm | WIDTH DIMENSION OF SHEET P/mm | SIZE OF SHEET P/ SETTING DIRECTION |
|---|---|---|
| 128 (±2) | 182 (±2) | B6/LATERAL |
| 11 (±2) in. | 8.5 (±2) in. | LETTER/LATERAL |

For example, when the length and width dimensions of the sheet P are detected as 210 mm and 297 mm, respectively, the size and the setting direction thereof are detected as A4 and the lateral setting, respectively. As described above, the setting direction of the sheet P is determined as a result of the detection of the length and width dimensions of the sheet P by the sheet rear end sensor 13 and the medium sensor 31. Therefore, each of the sheet rear end sensor 13 and the medium sensor 31 functions as at least a part of a detecting portion for detecting the setting direction of the sheet P.

Next, there will be described the first lateral-setting adaptation processing, shown in FIG. 12. In this processing, based on the detection of the setting direction of the sheet P by the sheet rear end sensor 13 and the medium sensor 31, as described above, it is judged whether the setting direction of the sheet P is the lateral setting (S2). When the setting direction of the sheet P is judged as the lateral setting, the variable G is changed to 2.8 mm (S4). When the setting direction of the sheet P is not judged as the lateral setting, the variable G is reset to the initial value, i.e., 2.0 mm (S3). Thus, the first lateral-setting adaptation processing is completed.

Figure 15A:
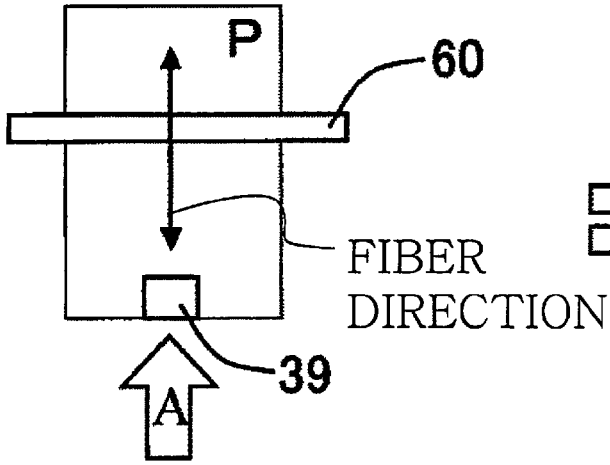
FIGS. 15A-15D are explanatory views for explaining a relationship between a deformation of the sheet and a fiber direction of the sheet.
Figure 15C:
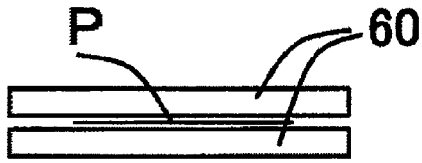
Figure 15B:
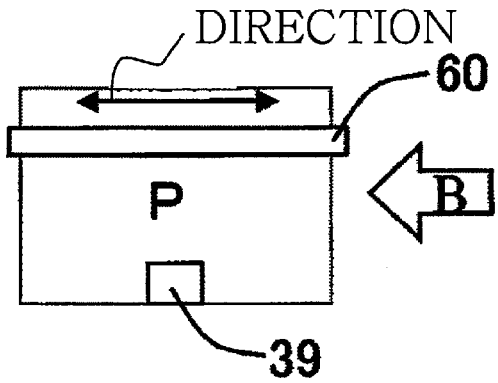
Figure 15D:
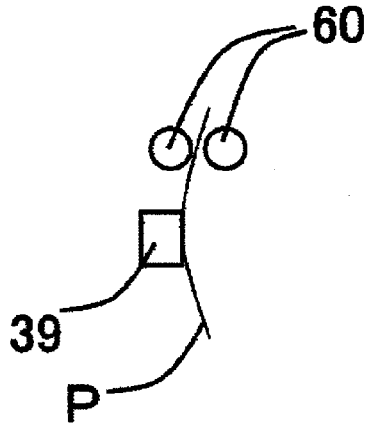

In the first lateral-setting adaptation processing, when the setting direction of the sheet P is detected as the lateral setting, the gap is set to be wider than the gap which is set when the setting direction of the sheet P is detected as the longitudinal setting. Therefore, in a case in which the sheet P is deformed in a direction parallel to the feed direction (as shown in FIG. 15B) and in which it is difficult to reduce a deformation amount of the sheet P by the pressing force of the sheet-feed roller 60, the sheet P does not contact the inkjet recording head 39. Accordingly, the sheet P can be smoothly fed, and it is possible to prevent the recording surface of the sheet P from being stained.

Hereinafter, there will be described a second embodiment of the present invention by reference to the drawings. Since a printer section relating to the second embodiment is configured to change an amount of the ink which is ejected from the inkjet recording head 39 according to the setting direction of the sheet P, the printer section does not need to have the gap adjustment mechanism (the first or the second example thereof) which is included in the printer section 2 in the first embodiment. It is noted that the same reference numerals as used in the first embodiment are used to designate the corresponding elements or parts of the second embodiment and the description thereof is omitted. Further, a method for detecting the setting direction of the sheet P is the same as the method described in the first embodiment.

Figure 13:
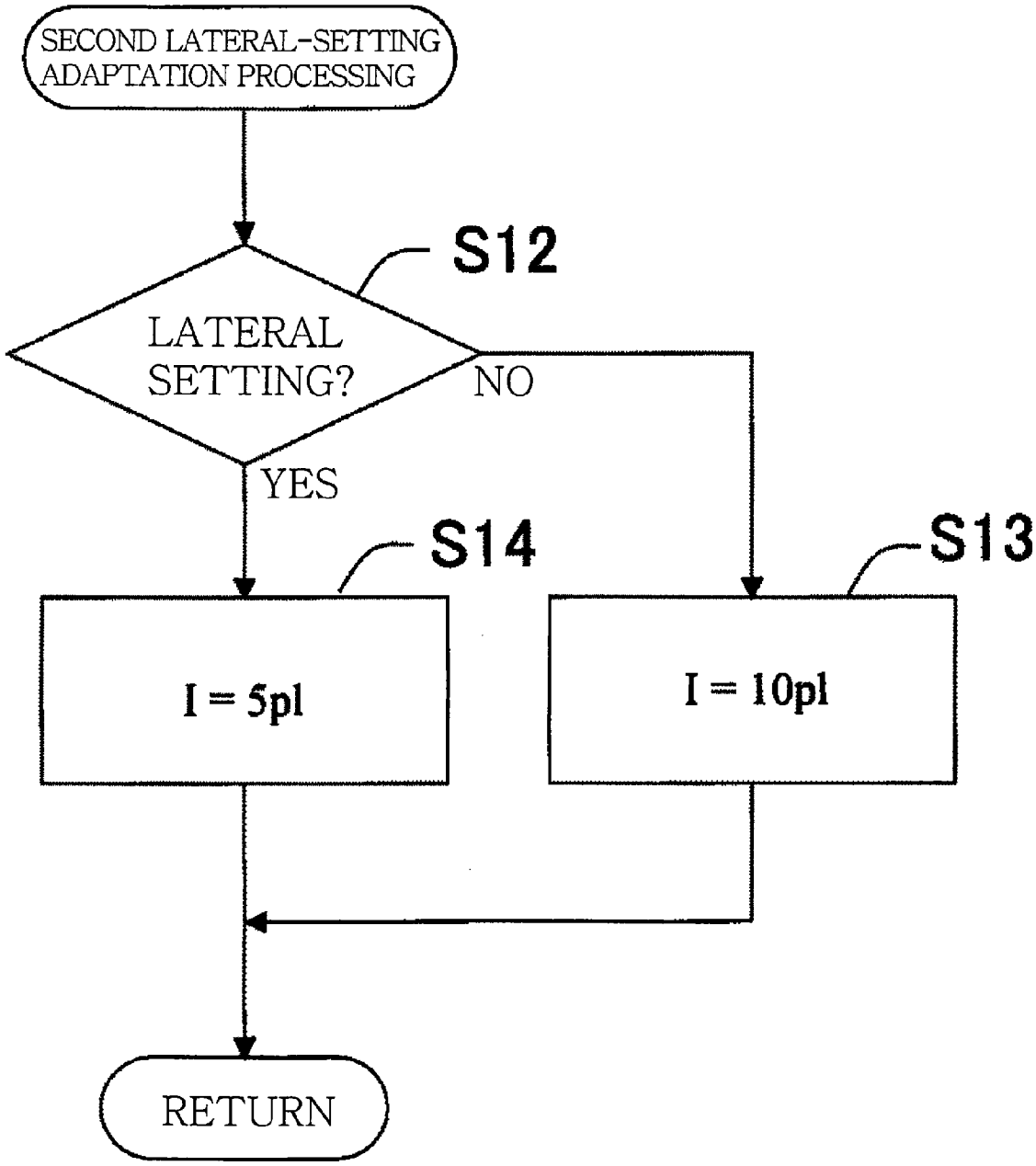
FIG. 13 is a flowchart of a second lateral-setting adaptation processing executable in the printing operation.

There will be described a printing operation of the printer section relating to the second embodiment, by referring to FIGS. 11 and 13. FIG. 13 is a flowchart of the second lateral-setting adaptation processing. In the second lateral-setting adaptation processing, there is executed an operation for reducing the amount of the ink which is ejected from the inkjet recording head 39 when the setting direction of the sheet P is detected as the lateral setting.

In the printing operation shown in FIG. 11, a variable I indicating an amount of the ink which is ejected from the inkjet recording head 39 (i.e., an ink-ejection amount) is set at 10 pl as an initial value (S31). Subsequently, it is judged whether there are any printing data (S32). When there are no printing data (S32: No), it is repeatedly judged whether there are any printing data. When there are some printing data (S32: Yes), a printing operation is started (S35). Then, it is judged whether the printing operation has been finished (S36). When the printing operation has not been finished (S36: No), the control goes back to "S32" in which it is judged whether there are any printing data, and the following steps are executed again. When the printing operation has been finished (S36: Yes), the control is ended. It is noted that, in the control section 64 (shown in FIG. 10), the drive circuit 75 receives the output signals generated by the ASIC 70 based on the drive-controlling procedure information outputted from the CPU 65 and drives the inkjet recording head 39 such that a predetermined amount of the ink is ejected from the inkjet recording head 39 to the sheet P at a predetermined timing.

Next, there will be described the second lateral-setting adaptation processing shown in FIG. 13. In the second lateral-setting adaptation processing, it is judged whether the setting direction of the sheet P is the lateral setting (S12). When it is judged that the sheet P is set in the lateral setting (S12: Yes), the variable I indicating the ink-ejection amount is changed to be a half of the ink-ejection amount as the initial value (S14). When it is judged that the sheet P is not set in the lateral setting (S12: No), the variable I is reset to the initial value, i.e., 10 pl (S13). Thus, the second lateral-setting adaptation processing is ended. It is noted that the ink-ejection amount is changed by changing the above-described output signals.

In the second lateral-setting adaptation processing, the ink-ejection amount which is set when the setting direction of the sheet P is detected as the lateral setting is smaller than the ink-ejection amount which is set when the setting direction of the sheet P is detected as the longitudinal setting. Therefore, the sheet P just absorbs an appropriate amount of the ink. Accordingly, the deformation of the sheet P due to the absorption of ink thereby can be minimized so that the sheet P can be smoothly carried.

Hereinafter, there will be described a third embodiment of the present invention by reference to the drawings. Since a printer section relating to the third embodiment is configured to change a length of a waiting time between each forward scanning (i.e., each scanning in one of opposite directions) and each backward scanning (i.e., each scanning in the other of the opposite directions) and each backward scanning and each forward scanning while the carriage 38 or the carriage 110 is reciprocated, according to the setting direction of the sheet P, the printer section does not need to have the gap adjustment mechanism (the first or the second example thereof) which is included in the above-described printer section 2 in the first embodiment. It is noted that the same reference numerals as used in the first embodiment are used to designate the corresponding elements or parts of the third embodiment and the description thereof is omitted. Further, a method for detecting the setting direction of the sheet P is the same as the method described in the first embodiment.

Figure 14:
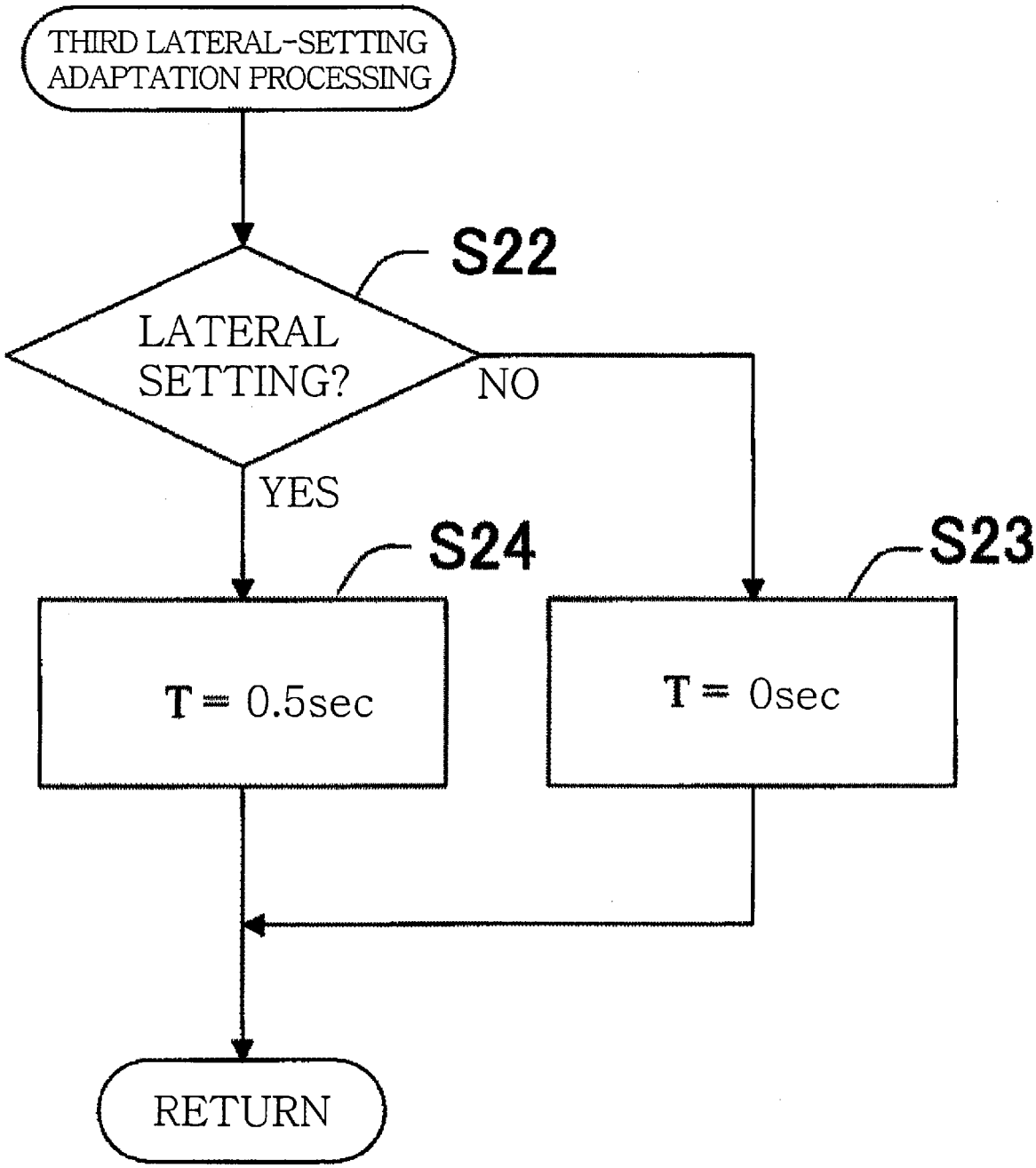
FIG. 14 is a flowchart of a third lateral-setting adaptation processing executable in the printing operation.

There will be described a printing operation of the printer section relating to the third embodiment, by referring to FIGS. 11 and 14. FIG. 14 is a flowchart of the third lateral-setting adaptation processing. In the third lateral-setting adaptation processing, there is executed an operation for increasing the waiting time between the forward scanning and the backward scanning while the carriage 38 or the carriage 110 is reciprocated when the setting direction of the sheet P is detected as the lateral setting.

In the printing operation shown in FIG. 11, a variable T indicating the length of the waiting time between the forward scanning and the backward scanning while the carriage 38 or the carriage 110 is reciprocated is set at 0 sec. as an initial value (S31). Subsequently, it is judged whether there are any printing data (S32). When there are no printing data (S32: No), it is repeatedly judged whether there are any printing data. When there are some printing data (S32: Yes), a printing operation is started (S35). Then, it is judged whether the printing operation has been finished (S36). When the printing operation has not been finished (S36: No), the control goes back to "S32" in which it is judged whether there are any printing data, and the following steps are executed again. When the printing has been finished (S36: Yes), the control is ended. It is noted that, in the control section 64 (shown in FIG. 10), the drive circuit 74 receives output signals outputted from the ASIC 70 and generates electric signals for rotating the CR motor 73. By receiving the electric signals, the CR motor 73 is rotated. The rotating force of the CR motor 73 is transmitted to the carriage 38 via the belt-driving mechanism 46, so that the carriage 38 is controlled to wait for a predetermined time between each forward scanning and each backward scanning and each backward scanning and each forward scanning. In the above-described manner, the reciprocating movement of the carriage 38 is controlled by the control section 64.

Next, there will be described the third lateral-setting adaptation processing, shown in FIG. 13. In the third lateral-setting adaptation processing, it is judged whether the setting direction of the sheet P is the lateral setting (S22). When the setting direction of the sheet P is judged as the lateral setting (S22: Yes), the variable T is changed such that the length of the waiting time between the forward scanning and the backward scanning of the carriage 38 or the carriage 110 is 0.5 sec (S24). When the setting direction of the sheet P is not judged as the lateral setting (S22: No), the variable T is reset to the initial value (S23). Thus, the third lateral-setting adaptation processing is ended.

In the third lateral-setting adaptation processing, the length of the waiting time which is set when the setting direction of the sheet P is detected as the lateral setting is greater than the length of the waiting time which is set when the setting direction of the sheet P is detected as the longitudinal setting. Therefore, the absorbed ink can be sufficiently fixed to the sheet P. Accordingly, the deformation of the sheet P can be minimized so that the sheet P can be smoothly fed and the recording surface of the sheet P can be prevented from being stained.

It is noted that the steps "S2", "S12", and "S22" correspond to a judgment portion of the control section 64 for judging the setting direction of the sheet P, and the steps "S3", "S4", "S13", "S14", "S23", and "S24" correspond to a changing control portion of the control section 64 for changing the value of the variable G, I or T.

It is to be understood that the present invention is not limited to the details of the embodiments illustrated hereinabove, but may be embodied with various changes without departing from the spirit of the present invention.

For example, in the above-described embodiments, the setting direction of the sheet P is detected as the lateral setting by the sheet rear end sensor 13 and the medium sensor 31. However, as the judgment portion for judging the setting direction of the sheet P, there may be adopted the operation panel 4 and an external computer which is connected to the printer section 2 such that the user can directly instruct the setting direction of the sheet P. In this case, the operation panel 4 and the external computer function as the judgment portion for judging the setting direction of the sheet P. Further, in this case, even if the instruction inputted by the user is not correct, the setting direction of the sheet P may be correctly detected by the sheet rear end sensor 13 and the medium sensor 31 so that the changing operation can be executed.

Further, in the above-described embodiments, as a result that the setting direction of the sheet P is detected as the lateral setting, the first, second or third lateral-setting adaptation processing is executed. However, an appropriate operation may be executed based on a judgment of the setting direction of the sheet P, for example, based on the fiber direction of the sheet P.

It is noted that the first and second examples of the gap adjustment mechanism in the first embodiment are based on U.S. patent application Ser. No. 11/563,368 filed on Nov. 27, 2006, the contents of which are incorporated herein by reference.

What is claimed is:

1. An inkjet recording apparatus comprising:

a setting portion on which a recording medium is set, the recording medium having a particular size and a rectangular shape having a first dimension and a second dimension which is less than the first dimension;

a feeder which feeds the recording medium from the setting portion in a feed direction;

a recording head which ejects ink so that an image is recorded on the recording medium fed by the feeder;

a gap changing device which changes a gap between the recording head and the recording medium;

a judgment portion which judges a setting direction of the recording medium on the setting portion and determines whether the first dimension of the recording medium set on the setting portion extends in a direction parallel to the feed direction or in a direction perpendicular to the feed direction; and a changing control portion which controls the gap changing device to change the gap between the recording head and the recording medium, according to the judged setting direction of the recording medium.

2. The inkjet recording apparatus according to claim 1, wherein the changing control portion controls the gap changing device such that the gap which is set when the first dimension of the recording medium set on the setting potion extends in the direction perpendicular to the feed direction is wider than the gap which is set when the first dimension of the recording medium set on the setting portion extends in the direction parallel to the feed direction.

3. The inkjet recording apparatus according to claim 1, further comprising:

a detecting portion which detects the first dimension and the second dimension of the recording medium, wherein the judgment portion is configured to judge the setting direction of the recording medium on the basis of a result of detecting by the detecting portion.

4. The inkjet recording apparatus according to claim 3, wherein the detecting portion includes (a) a first recording medium sensor provided, in the setting portion, for detecting one of the first dimension and the second dimension of the recording medium as measured in the direction parallel to the feed direction and (b) a second recording medium sensor provided, in the recording head, for detecting the other of the first dimension and the second dimension of the recording medium as measured in the direction perpendicular to the feed direction.

5. An inkjet recording apparatus comprising:

a setting portion on which a recording medium is set, the recording medium having a particular size and a rectangular shape having a first dimension and a second dimension which is less than the first dimension;

a feeder which feeds the recording medium from the setting portion in a feed direction;

a recording head which ejects ink so that an image is recorded on the recording medium fed by the feeder;

a drive circuit which drives the recording head such that an amount of the ink to be ejected from the recording head is changeable during a printing operation in which the ink is ejected;

a judgment portion which judges a setting direction of the recording medium on the setting portion and determines whether the first dimension of the recording medium set on the setting portion extends in a direction parallel to the feed direction or in a direction perpendicular to the feed direction; and a changing control portion which controls the drive circuit to change the amount of the ink to be ejected from the recording head, according to the judged setting direction of the recording medium.

6. The inkjet recording apparatus according to claim 5, wherein the changing control portion controls the drive circuit such that the amount of the ink to be ejected from the recording head which is set when the first dimension of the recording medium set on the setting potion extends in the direction perpendicular to the feed direction is less than the amount of the ink to be ejected from the recording head which is set when the first dimension of the recording medium set on the setting potion extends in the direction parallel to the feed direction.

7. The inkjet recording apparatus according to claim 5, further comprising:

a detecting portion which detects the first dimension and the second dimension of the recording medium, wherein the judgment portion is configured to judge the setting direction of the recording medium on the basis of a result of detecting by the detecting portion.

8. The inkjet recording apparatus according to claim 7, wherein the detecting portion includes (a) a first recording medium sensor provided, in the setting portion, for detecting one of the first dimension and the second dimension of the recording medium as measured in a direction parallel to the feed direction and (b) a second recording medium sensor provided, in the recording head, for detecting the other of the first dimension and the second dimension of the recording medium as measured in a direction perpendicular to the feed direction.

9. An inkjet recording apparatus comprising:

a setting portion on which a recording medium is set, the recording medium having a particular size and a rectangular shape having a first dimension and a second dimension which is less than the first dimension;

a feeder which feeds the recording medium from the setting portion in a feed direction;

a recording head which ejects ink so that an image is recorded on the recording medium fed by the feeder;

a carriage which carries the recording head and which is reciprocated relative to the recording medium in opposite directions;

a judgment portion which judges a setting direction of the recording medium on the setting portion and determines whether the first dimension of the recording medium set on the setting portion extends in a direction parallel to the feed direction or in a direction perpendicular to the feed direction; and a changing control portion which controls the carriage to change a waiting time thereof between a scanning thereof in one of the opposite directions and a scanning thereof in the other of the opposite directions, according to the judged setting direction of the recording medium.

10. The inkjet recording apparatus according to claim 9, wherein the changing control portion controls the carriage such that the waiting time of the carriage which is set when the first dimension of the recording medium set on the setting portion extends in the direction perpendicular to the feed direction is longer than the waiting time of the carriage which is set when the first dimension of the recording medium set on the setting portion extends in the direction parallel to the feed direction.

11. The inkjet recording apparatus according to claim 9, further comprising:

a detecting portion which detects the first dimension and the second dimension of the recording medium, wherein the judgment portion is configured to judge the setting direction of the recording medium on the basis of a result of detecting by the detecting portion.

12. The inkjet recording apparatus according to claim 11, wherein the detecting portion includes (a) a first recording medium sensor provided, in the setting portion, for detecting one of the first dimension and the second dimension of the recording medium as measured in a direction parallel to the feed direction and (b) a second recording medium sensor provided, in the recording head, for detecting the other of the first dimension and the second dimension of the recording medium as measured in a direction perpendicular to the feed direction.

* * * * *